US009733588B2

(12) United States Patent
Lee et al.

(10) Patent No.: US 9,733,588 B2
(45) Date of Patent: Aug. 15, 2017

(54) EXPOSURE DEVICE AND IMAGE FORMING APPARATUS ADOPTING THE SAME

(71) Applicant: SAMSUNG ELECTRONICS CO., LTD., Suwon-si, Gyeonggi-do (KR)

(72) Inventors: In-sung Lee, Suwon (KR); Chul-hyun Park, Yongin (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/155,217

(22) Filed: May 16, 2016

(65) Prior Publication Data

US 2016/0363885 A1 Dec. 15, 2016

(30) Foreign Application Priority Data

Jun. 11, 2015 (KR) ..... 10-2015-0082574

(51) Int. Cl.
*G03G 15/00* (2006.01)
*G03G 15/043* (2006.01)
*G03G 15/04* (2006.01)

(52) U.S. Cl.
CPC ... *G03G 15/0435* (2013.01); *G03G 15/04054* (2013.01)

(58) Field of Classification Search
USPC ..... 399/1–4, 177; 347/238, 245
See application file for complete search history.

(56) References Cited

U.S. PATENT DOCUMENTS 7,995,085 B2 * 8/2011 Nomura ..... B41J 2/451 347/238
8,514,259 B2 * 8/2013 Yokoi ..... G03G 15/04054 347/234
8,836,745 B2 * 9/2014 Sato ..... G03G 15/04054 347/245

FOREIGN PATENT DOCUMENTS

JP 5293872 9/2013

* cited by examiner

*Primary Examiner* — Hoan Tran
(74) *Attorney, Agent, or Firm* — Staas & Halsey LLP

(57) ABSTRACT

An exposure device capable of precisely focusing light on a scanned surface to accomplish a good image quality is provided. The exposure device includes a substrate on which a plurality of light sources are arranged along a main-scanning direction, a lens array including a plurality of lenses configured to focus light emitted by the plurality of light sources on a scanned surface, and a housing configured to support the substrate and the lens array such that a certain spacing is maintained between the plurality of light sources and the plurality of lenses. At least a portion of the substrate is spaced apart from the housing along a sub-scanning direction.

18 Claims, 22 Drawing Sheets

EXPOSURE DEVICE AND IMAGE FORMING APPARATUS ADOPTING THE SAME

CROSS-REFERENCE TO RELATED APPLICATION

This application claims the priority benefit of Korean Patent Application No. 10-2015-0082574, filed on Jun. 11, 2015, in the Korean Intellectual Property Office, the disclosure of which is incorporated herein in its entirety by reference.

BACKGROUND

1. Field

The present disclosure relates to an exposure device and an image forming apparatus adopting the same.

2. Description of the Related Art

In an image forming apparatus, in particular, an electrophtographic image forming apparatus, light modulated with image information is emitted to a photosensitive medium charged with a certain electric potential such that an electrostatic latent image is formed on a surface of the photosensitive medium, toner is provided to the electrostatic latent image to develop the electrostatic latent image into a visible toner image, and the toner image is transferred to a printing medium so that the toner image is printed on the printing medium.

An exposure device is used to emit light to the photosensitive medium to form the electrostatic latent image on the surface of the photosensitive medium. An example of the exposure device may be an LED-type exposure device in which a plurality of light emitting diodes (LEDs) disposed in main-scanning direction are selectively turned on according to the image information.

The LED-type exposure device does not include some components such as a polygon mirror, contrarily to a laser scanning unit (LSU) which is another kind of exposure device, may be miniaturized, and generates less noise.

However, if a spacing between the light emitting diodes and a lens array is reduced for miniaturization, image quality may be deteriorated even by small variations that may occur in a production of the device.

SUMMARY

Provided is an exposure device that may precisely focus light on a scanned surface to accomplish a good image quality.

An exposure device according to an embodiment includes: a substrate on which a plurality of light sources are arranged along a main-scanning direction; a lens array including a plurality of lenses configured to focus light emitted by the plurality of light sources on a scanned surface; and a housing configured to support the substrate and the lens array such that a certain spacing is maintained between the plurality of light sources and the plurality of lenses. At least a portion of the substrate is spaced apart from the housing along a sub-scanning direction.

A distance between the substrate and the housing in the sub-scanning direction may range from 10% to 100% of a width of the substrate.

The housing may include a first supporting region configured to support the substrate in the sub-scanning direction, and a first separation region spaced apart from the substrate in the sub-scanning direction.

A width of the first separation region may be greater than a width of the first supporting region.

The substrate may include a second supporting region supported by the first supporting region in the sub-scanning direction, and a second separation region spaced apart from the first separation region in the sub-scanning direction.

A width of the second separation region may be less than a width of the second supporting region.

A separation distance between the first supporting region and the second supporting region may be greater than or equal to about 10% of a width of the second supporting region.

The separation distance between the first separation region and the second separation region may be less than or equal to about 100% of a width of the second supporting region.

The housing may include a supporting face configured to support the substrate in a direction perpendicular to the sub-scanning direction and the main-scanning direction, and an insertion space recessed inwardly from the supporting face and spaced apart from the substrate.

The supporting face may include a first supporting face configured to support a central portion of the substrate, and a second supporting face configured to support both ends of the substrate.

The housing may include a lens supporting portion configured to accommodate at least a portion of the lens array, and a slope portion of which a height is lowered in an outward direction from an end of the lens supporting portion.

The slope portion may include a plurality of slanting walls displaced apart in the sub-scanning direction.

A through hole may be disposed in an end of the slope portion.

The housing may include a slope guide portion elongated in a direction slanting from the main-scanning direction. The exposure device may further include at least one position setting member. At least a portion of the position setting member contacts the slope guide portion of the housing, and the position setting member is configured to be fixed to the housing.

The substrate may be fixed to the housing by gluing.

An exposure device according to another embodiment includes: a substrate on which a plurality of light sources are arranged along a main-scanning direction; a lens array including a plurality of lenses configured to focus light emitted by the plurality of light sources on a scanned surface; a housing configured to support the substrate and the plurality of lenses such that a certain spacing is maintained between the plurality of light sources and the plurality of lenses; and at least one position setting member configured to be fixed to the housing. The housing includes a slope guide portion elongated in a direction slanting from the main-scanning direction and configured to contact the at least one position setting member.

The at least one position setting member may be fixed to the housing by gluing.

The at least one position setting member may include a contact portion configured to contact the slope guide portion of the housing, and a stopper faced to a surface opposite to the slope guide portion of the housing.

According to yet another embodiment, provided is an image forming apparatus including the exposure device described above.

BRIEF DESCRIPTION OF THE DRAWINGS

These and/or other aspects will become apparent and more readily appreciated from the following description of the exemplary embodiments, taken in conjunction with the accompanying drawings.

DETAILED DESCRIPTION

Figure 1:
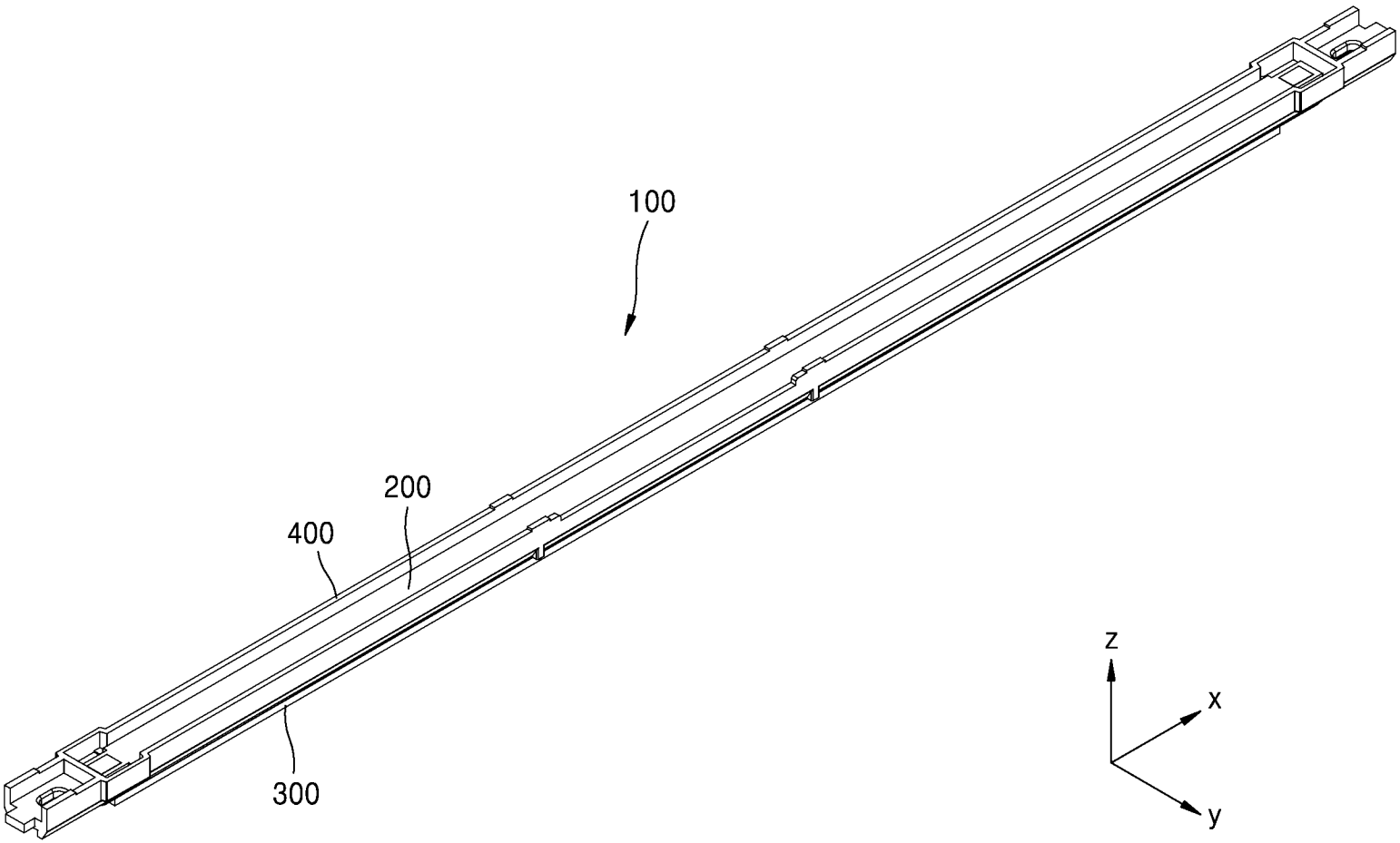
FIG. 1 is a perspective view of an exposure device in an assembled state according to an embodiment.

Before describing the disclosure in detail, terminologies used herein will be discussed briefly.

Although general terms widely used at present were selected for describing the exemplary embodiments in consideration of the functions thereof, these general terms may vary according to intentions of one of ordinary skill in the art, case precedents, the advent of new technologies, and the like. Terms arbitrarily selected by the applicant may also be used in a specific case. In this case, their meanings need to be given in the detailed description of the present disclosure. Hence, the terms must be defined based on their meanings and the contents of the entire specification, not by simply stating the terms.

The terms "comprises" and/or "comprising" or "includes" and/or "including", when used in this specification, specify the presence of stated elements, but do not preclude the presence or addition of one or more other elements.

Also, the terminologies including ordinals such as "first" and "second" used to explain various elements in this specification are used to discriminate an element from the other ones and do not limits the disclosure.

Reference will now be made in detail to exemplary embodiments, examples of which are illustrated in the accompanying drawings, wherein like reference characters refer to like elements throughout. In this regard, the present exemplary embodiments may have different forms and should not be construed as being limited to the descriptions set forth herein. Accordingly, the exemplary embodiments are merely described below, by referring to the figures, to explain aspects. The same or similar components may be designated by the same or similar reference characters although they are illustrated in different drawings.

Figure 2A:
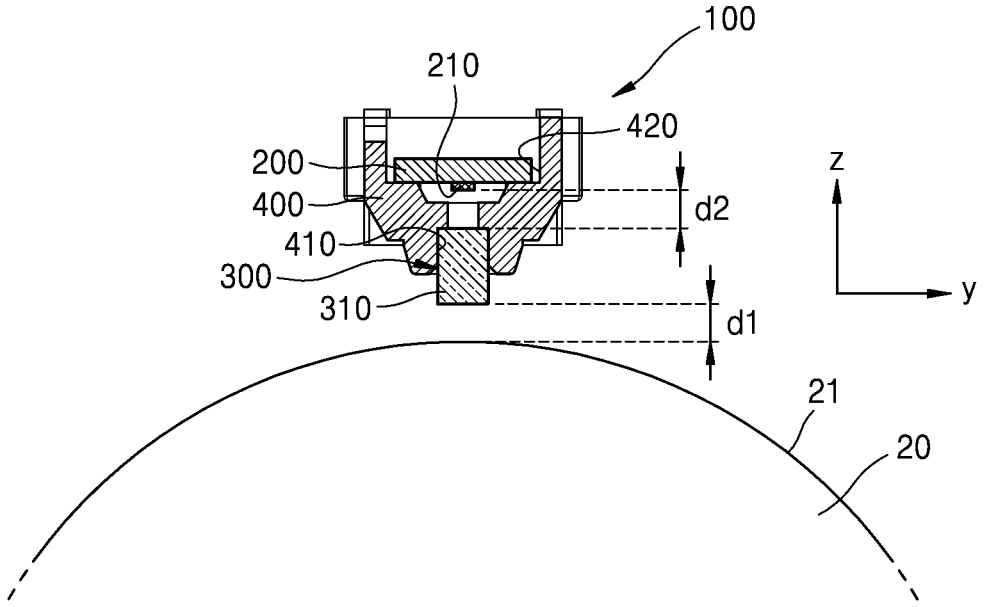
FIGS. 2A and 2B are exemplary sectional views of the exposure device of FIG. 1.
Figure 2B:
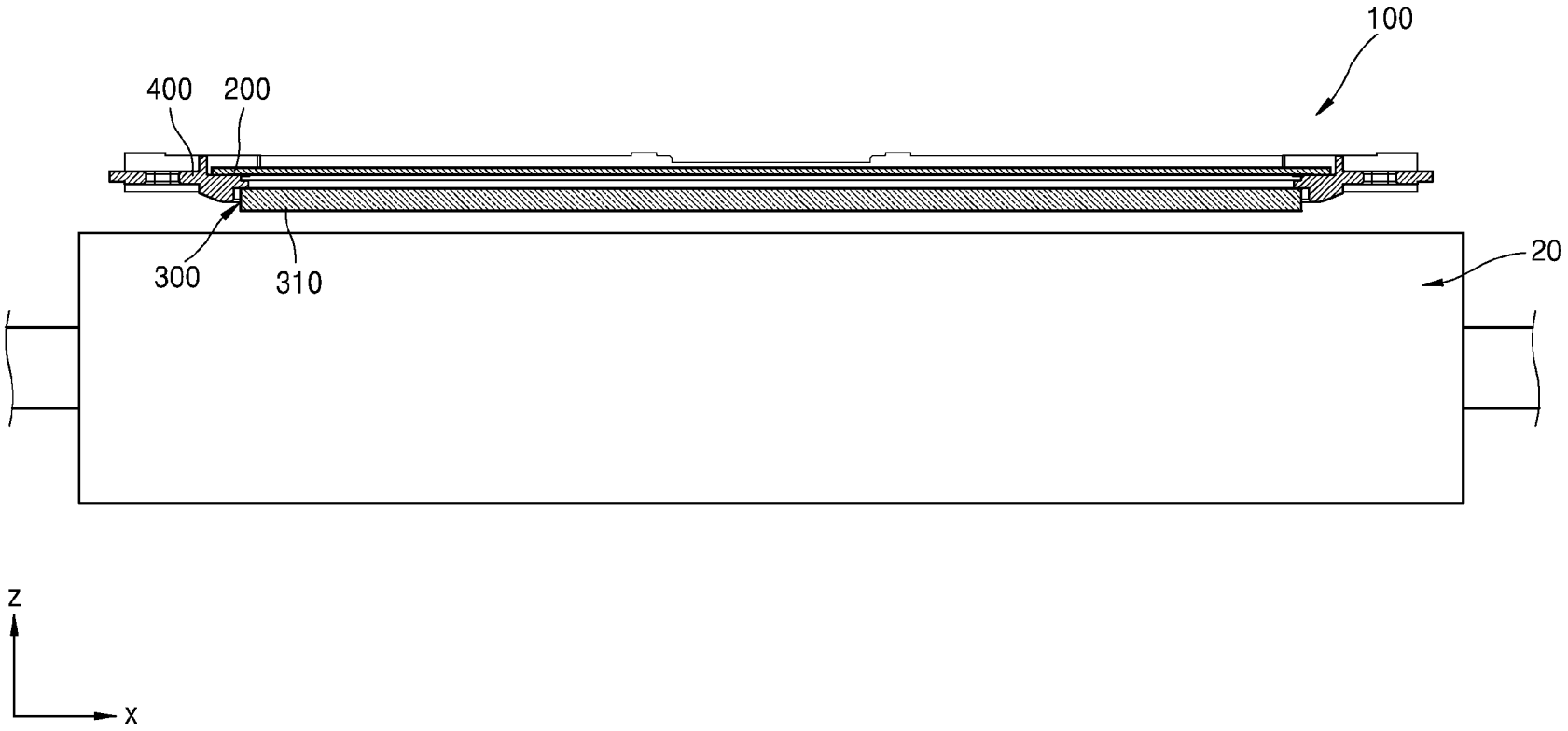
Figure 3A:
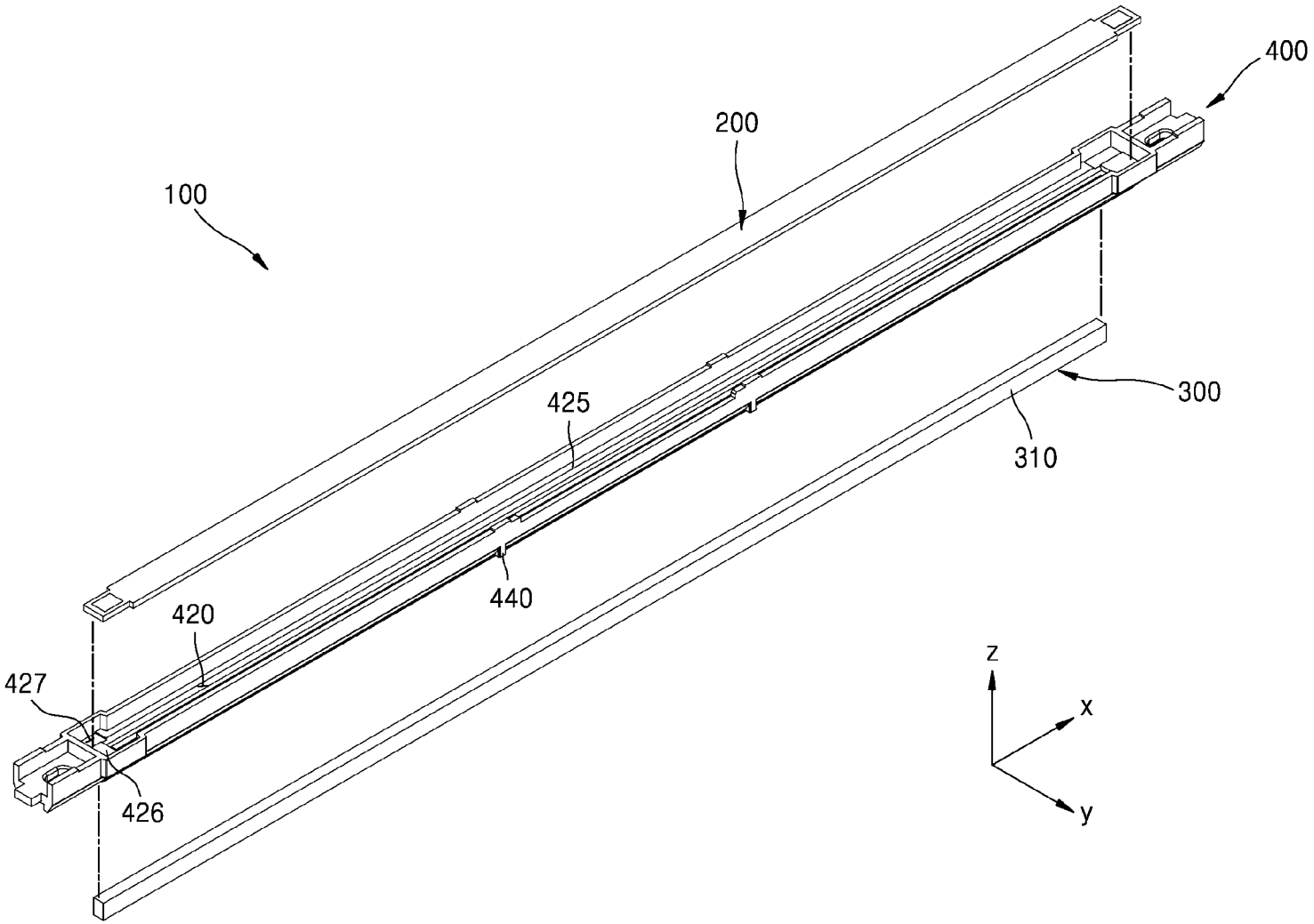
FIGS. 3A and 3B are exemplary exploded views of the exposure device of FIG. 1 seen from different directions.
Figure 3B:
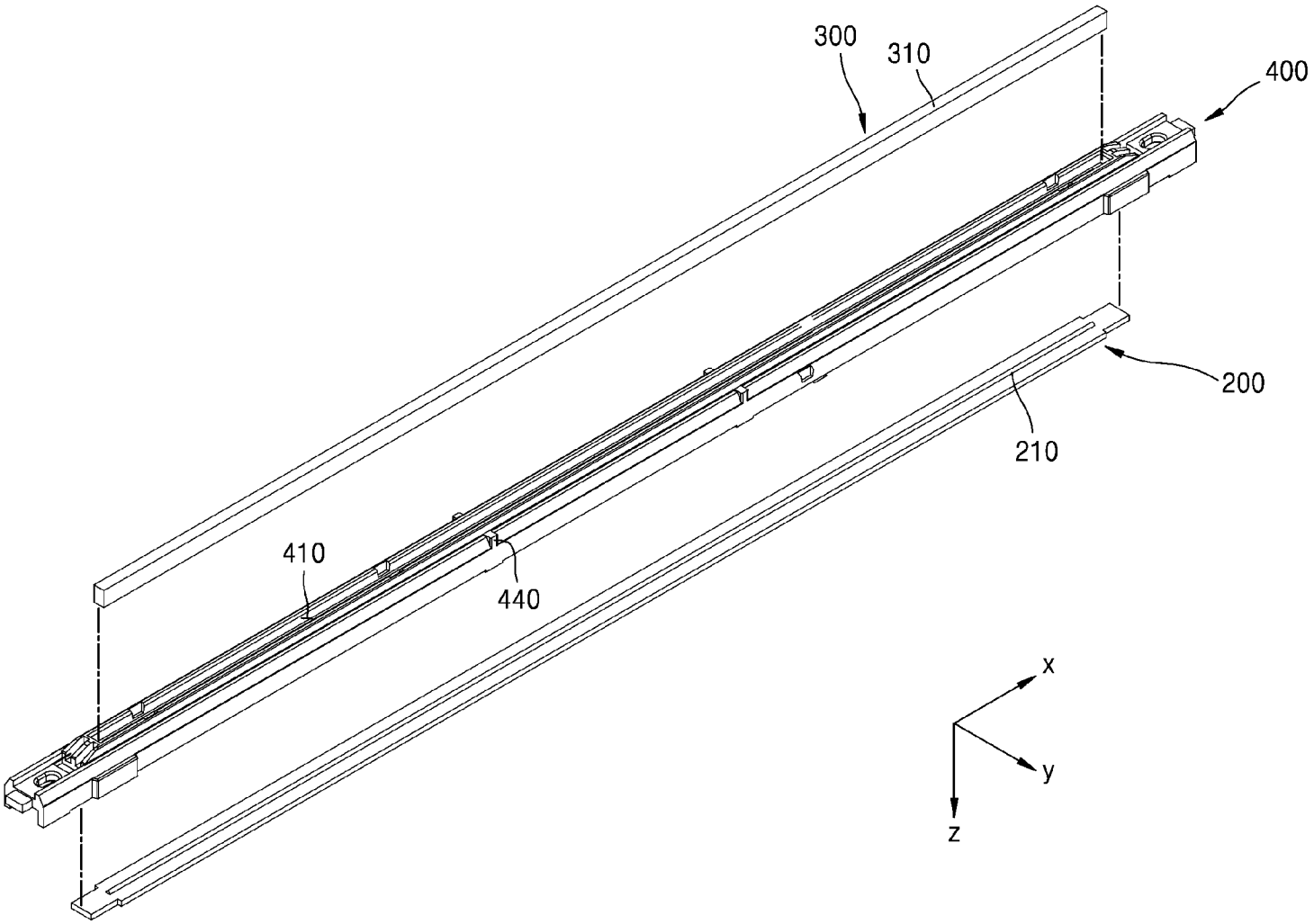

FIG. 1 is a perspective view of an exposure device 100 in an assembled state according to an embodiment, FIGS. 2A and 2B are sectional views of the exposure device 100 of FIG. 1, and FIGS. 3A and 3B are exploded views of the exposure device 100 of FIG. 1, seen from different viewpoints. FIG. 2A is a sectional view cut along a sub-scanning direction, i.e. a direction of the y-axis, and FIG. 2B is a sectional view cut along a main-scanning direction, i.e. a direction of the x-axis.

Referring to FIGS. 1 through 3B, at least a part of the exposure device 100 is spaced apart from a scanned surface 21 and emits light on the scanned surface 21. A separation distance d1 between the exposure device 100 and the scanned surface 21 may be in a range of about 2.45 mm to about 2.55 mm. The scanned surface 21 may be a surface of a photosensitive drum 20. A longitudinal direction of the exposure device 100 (x-axis direction) may be referred to as a main-scanning direction, a width direction (y-axis direction) may be referred to as a sub-scanning direction, and a height direction (z-axis direction) may be referred to as an optical axis direction.

The exposure device 100 may emit light on a surface of the photosensitive drum 20 in the main-scanning direction (x-axis direction). The exposure device 100 may include, for example, a substrate 200, a lens array 300, and a housing 400 configured to support the substrate 200 and the lens array 300.

A plurality of light sources 210 may be disposed on the substrate 200. The substrate 200 may be a circuit board that controls the plurality of light sources 210. The plurality of light sources 210 may be disposed along the main-scanning direction (x-axis direction). For example, the plurality of light sources 210 may be disposed in a zigzag pattern along the main-scanning direction (x-axis direction). Among the plurality of light sources 210, every odd-numbered light sources and even-numbered light sources may be spaced apart in the sub-scanning direction (y-axis direction) while being disposed along the main-scanning direction (x-axis direction).

The light sources 210 generate light and may be LED type. Each light source 210 may include a plurality of LED chips. However, a type or number of light sources 210 is not limited thereto, and various light sources that can emit light on the scanned surface 21 may be used.

The lens array 300 includes a plurality of lenses 310. The plurality of lenses 310 may be disposed along the main-scanning direction (x-axis direction). For example, the plurality of lenses 310 may be disposed in a zigzag pattern or a staggered arrangement. The plurality of lenses 310 may focus light emitted by the plurality of light sources 210 on the scanned surface 21.

The plurality of lenses 310 may be spaced apart from the light sources 210. For example, the plurality of lenses 310 and the light sources 210 may be spaced apart from each other in the optical axis direction (z-axis direction). The optical axis direction (z-axis direction) may be perpendicular to both the main-scanning direction (x-axis direction) and the sub-scanning direction (y-axis direction). The spacing d2 between the plurality of lenses 310 and the light source 210 in the optical axis direction (z-axis direction) may be in a range of about 2.45 mm to about 2.55 mm.

The housing 400 may support the substrate 200 and the lens array 300 so that the plurality of lenses 310 and the plurality of light sources 210 maintain the spacing d2. The housing 400 may be made of plastic material.

The housing 400 may include a lens supporting portion 410 supporting the lens array 300 and a substrate supporting portion 420 supporting the substrate 200. The lens supporting portion 410 may have a cross-sectional shape corresponding to a shape of the lens array 300 in a direction perpendicular to the optical axis direction (z-axis direction), namely in a plane parallel to an x-y plane. An exemplary shape of the substrate supporting portion 420 is described.

An error deviating from a desired numerical range may occur during a manufacture of the housing 400 including the lens supporting portion 410 and the substrate supporting portion 420. Further, another error deviating from a corresponding desired numerical range may also occur during the manufacture of the substrate 200 and the lens array 300. The errors may range, for example, from a few micrometers to dozens of micrometers.

Such errors may directly affect printing quality of an image forming apparatus that requires precision. Thus, according to an embodiment, a structure of the exposure device 100 is improved to facilitate compensation for the errors.

Figure 4A:
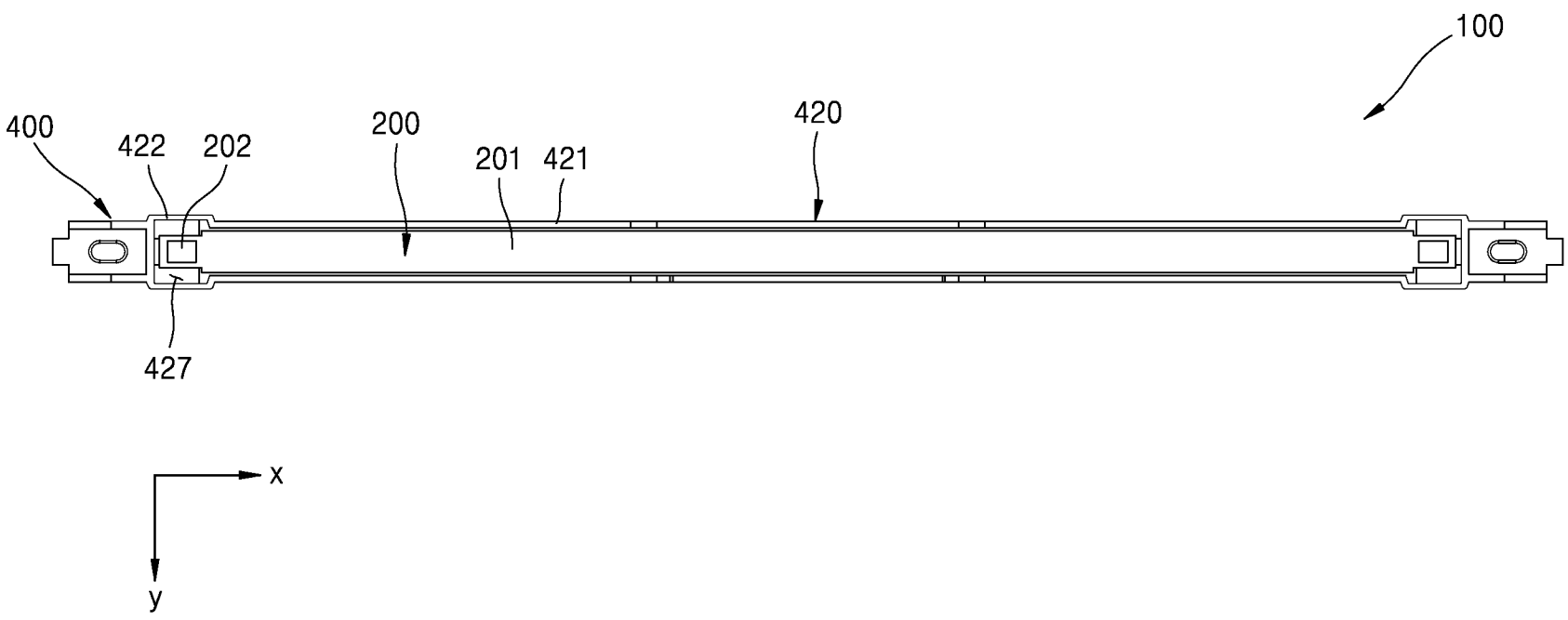
FIG. 4A is an exemplary plane view of the exposure device of FIG. 1.
Figure 4B:
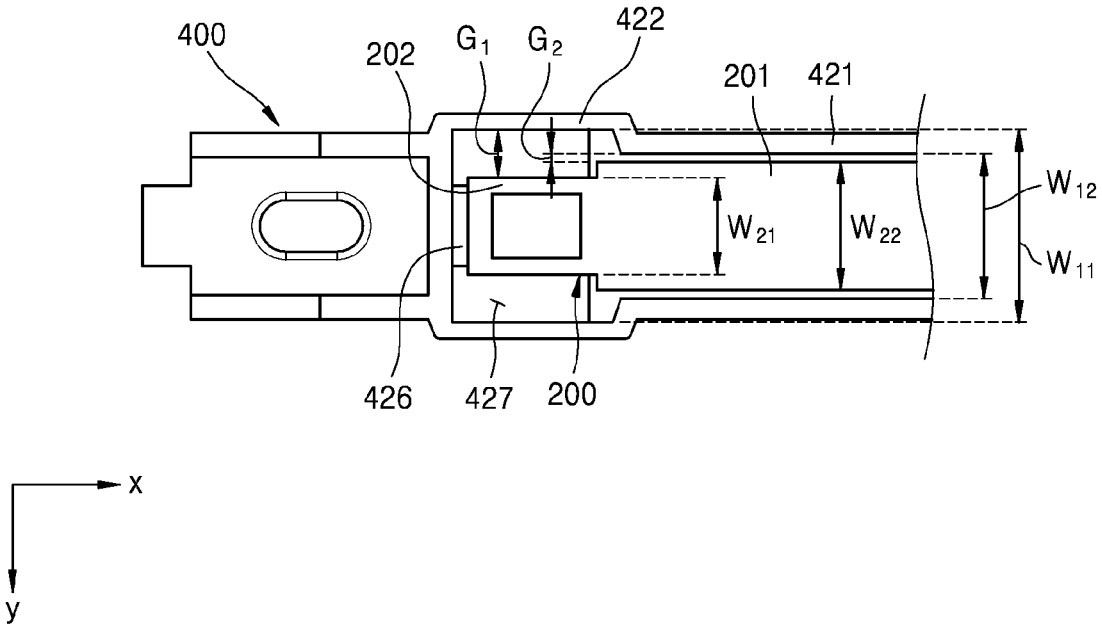
FIG. 4B is an exemplary partially enlarged view of FIG. 4A.

FIG. 4A is a plane view of the exposure device 100 of FIG. 1, and FIG. 4B is a partially enlarged view of FIG. 4A.

Referring to FIGS. 2A, 2B, 4A, and 4B, at least a portion of the substrate 200 may be spaced apart from the housing 400 in the sub-scanning direction (y-axis direction). Accordingly, the substrate 200 with the plurality of light sources 210 thereon may be moved or tilted in the sub-scanning direction (y-axis direction) during the manufacture thereof. As used herein, the expression "tilting" may include a rotation of a portion of the substrate 200 with respect to another portion of the substrate 200.

A separation distance between the substrate 200 and the housing 400 in the sub-scanning direction (y-axis direction) may be greater than 10% of a width of the substrate 200. The separation distance between the substrate 200 and the housing 400 in the sub-scanning direction (y-axis direction) may include separation distances between both ends of the substrate 200 and the housing 400 in the sub-scanning direction (y-axis direction). For example, the separation distance between the substrate 200 and the housing 400 in the sub-scanning direction (y-axis direction) may be a sum of a separation distance between one end of the substrate 200 and the housing 400 in the sub-scanning direction (y-axis direction) and another separation distance between the other end of the substrate 200 and the housing 400 in the sub-scanning direction (y-axis direction). The separation distance between the substrate 200 and the housing 400 in the sub-scanning direction (y-axis direction) may be greater than about 10% of a maximum width of the substrate 200. For example, when the maximum width of the substrate 200 is about 8 mm, the separation distance between the substrate 200 and the housing 400 in the sub-scanning direction (y-axis direction) may be about 1 mm, which is 12.5% of the maximum width of the substrate 200. An exemplary width direction of the substrate 200 is the sub-scanning direction (y-axis direction), and the maximum width of the substrate 200 may be a width of a second supporting region 201, $W_{22}$, which is described below.

The separation distance between the substrate 200 and the housing 400 in the sub-scanning direction (y-axis direction), may be less than or equal to about 100% of the width of the substrate 200. For example, the separation distance between the substrate 200 and the housing 400 in the sub-scanning direction (y-axis direction) may be less than or equal to about 100% of a minimum width of the substrate 200. For example, when the minimum width of the substrate 200 is about 6 mm, the separation distance between the substrate 200 and the housing 400 in the sub-scanning direction (y-axis direction) may be about 6 mm, which is about 100% of the minimum width of the substrate 200. According to an exemplary embodiment, the minimum width of the substrate 200 may be a width of a second separation region 202, $W_{21}$, which is described below.

The substrate supporting portion 420 of the housing 400 may include a first supporting region 421 for supporting the substrate 200 in the sub-scanning direction (y-axis direction) and a first separation region 422 spaced apart from the substrate 200 in the sub-scanning direction (y-axis direction). The substrate 200 may include the second supporting region 201 supported by the first supporting region 421 of the housing 400 in the sub-scanning direction (y-axis direction), and the second separation region 202 spaced apart from the first separation region 422 of the housing 400 in the sub-scanning direction (y-axis direction). An adhesion bond (not shown) may be arranged between the first supporting region 421 of the housing 400 and the second supporting region 201 of the substrate 200. The first supporting region 421 may support the second supporting region 201 through the adhesion bond.

The width $W_{11}$ of the first separation region 422 of the substrate supporting portion 420 may be greater than a width $W_{12}$ of the first supporting region 421. For example, the width $W_{11}$ of the first separation region 422 of the substrate supporting portion 420 may be about 12 mm while the width $W_{12}$ of the first supporting region 421 may be about 9 mm.

The width $W_{21}$ of the second separation region 202 of the substrate 200 may be less than the width $W_{22}$ of the second supporting region 201. For example, the width $W_{21}$ of the second separation region 202 of the substrate 200 may be about 6 mm while the width $W_{22}$ of the second supporting region 201 may be about 8 mm.

A separation distance G1 between the first separation region 422 of the substrate supporting portion 420 and one end of the second separation region 202 of the substrate 200 may be greater than a separation distance G2 between the first supporting region 421 of the substrate supporting portion 420 and one end of the second supporting region 201 of the substrate 200. For example, the separation distance G1 between the first separation region 422 of the substrate supporting portion 420 and one end of the second separation region 202 of the substrate 200 may be about 3 mm, and the separation distance G2 between the first supporting region 421 of the substrate supporting portion 420 and one end of the second supporting region 201 of the substrate 200 may be about 0.5 mm. The separation distance between the first separation region 422 of the substrate supporting portion 420 and the second separation region 202 of the substrate 200 may be about 6 mm, and the separation distance between the first supporting region 421 of the substrate supporting portion 420 and the second supporting region 201 of the substrate 200 may about 1 mm. The separation distance between the first separation region 422 and the second separation region 202 may be a difference between the width of the first separation region 422 and the width of the second separation region 202.

The separation distance between the first supporting region 421 of the substrate supporting portion 420 and the second supporting region 201 of the substrate 200 may be less than or equal to 100% of the width of the second separation region 202 of the substrate 200. For example, when the width of the second separation region 202 of the substrate 200 is about 6 mm, the separation distance between the first separation region 422 of the substrate supporting portion 420 and the second separation region 202 of the substrate 200 may be about 6 mm, which is about 100% of the width of the second separation region 202.

The separation distance between the first separation region 422 of the substrate supporting portion 420 and the second separation region 202 of the substrate 200 may be greater than or equal to 10% of the width of the second supporting region 201 of the substrate 200. For example, when the width of the second supporting region 201 of the substrate 200 is about 8 mm, the separation distance between the first supporting region 421 of the substrate supporting portion 420 and the second supporting region 201 of the substrate 200 may be about 1 mm, which is about 12.5% of the width of the second supporting region 201.

Figure 5A:
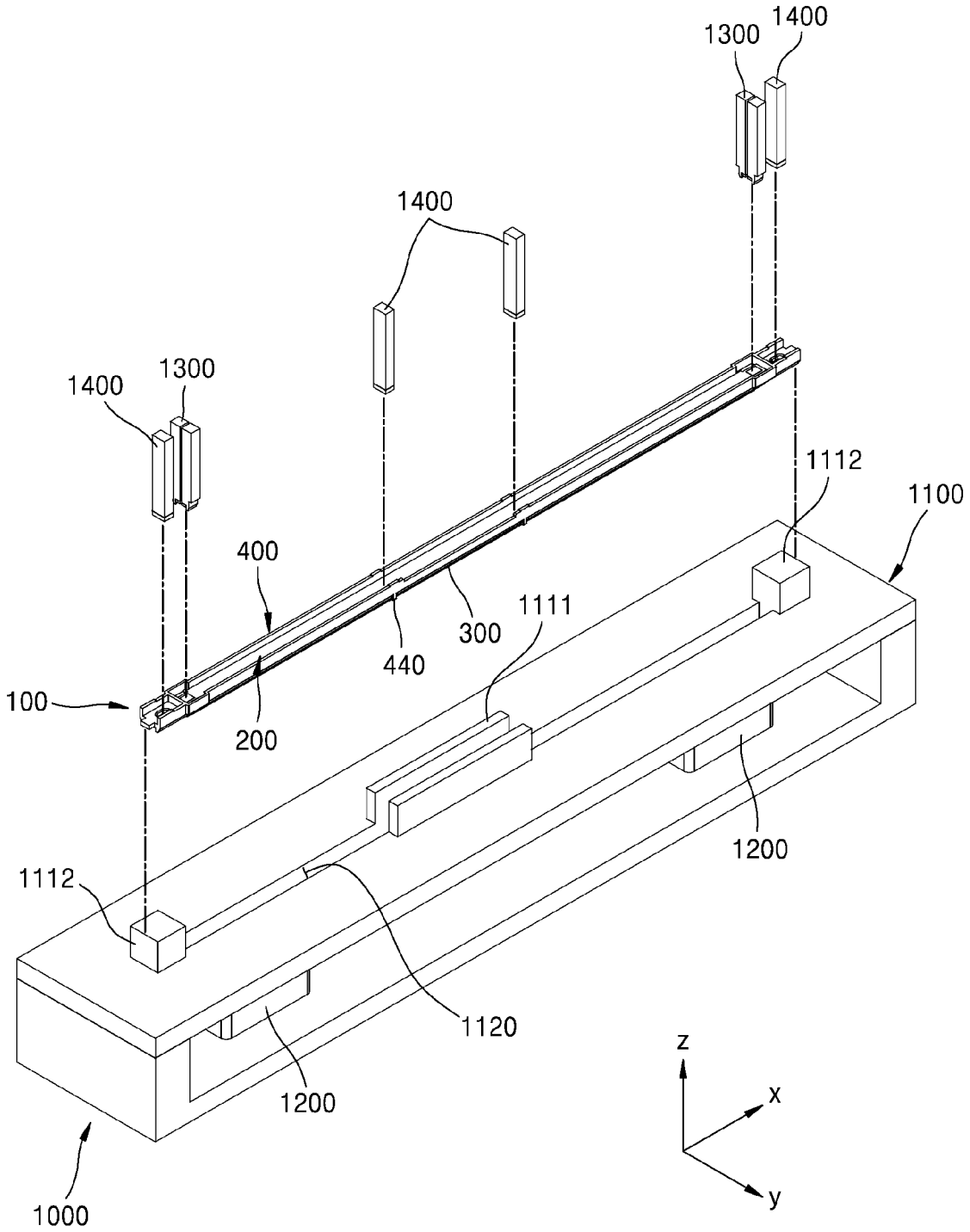
FIGS. 5A, 5B, 6A, 6B, and 6C illustrate an exemplary process of adjusting a position of a substrate in a housing during a manufacture of an exposure device.

An adjustment gripper having a reference character 1300 in FIG. 5A may be inserted between the first separation region 422 of the substrate supporting portion 420 and the second separation region 202 of the substrate 200. Accordingly, during the manufacture of the exposure device 100, the position of the substrate 200 with respect to the lens array 300 may be adjusted by the adjustment gripper 1300 after the substrate 200 and the lens array 300 are disposed in the substrate supporting portion 420 and the lens supporting portion 410, respectively, of the housing 400.

The substrate supporting portion 420 includes a supporting face configured to support the substrate 200 in the optical axis direction (z-axis direction) and an insertion space 427 which is recessed inwardly from the supporting face in the optical axis direction (z-axis direction). The insertion space 427 may be spaced apart from the substrate 200. Alternatively, the housing 400 may not be formed with the insertion space 427.

The supporting face may have a second supporting face 426 configured to support both ends of the substrate 200 in a longitudinal direction and a first supporting face 425 configured to support a portion between the both ends of the substrate 200, for example, a central portion of the substrate 200.

Figure 5B:
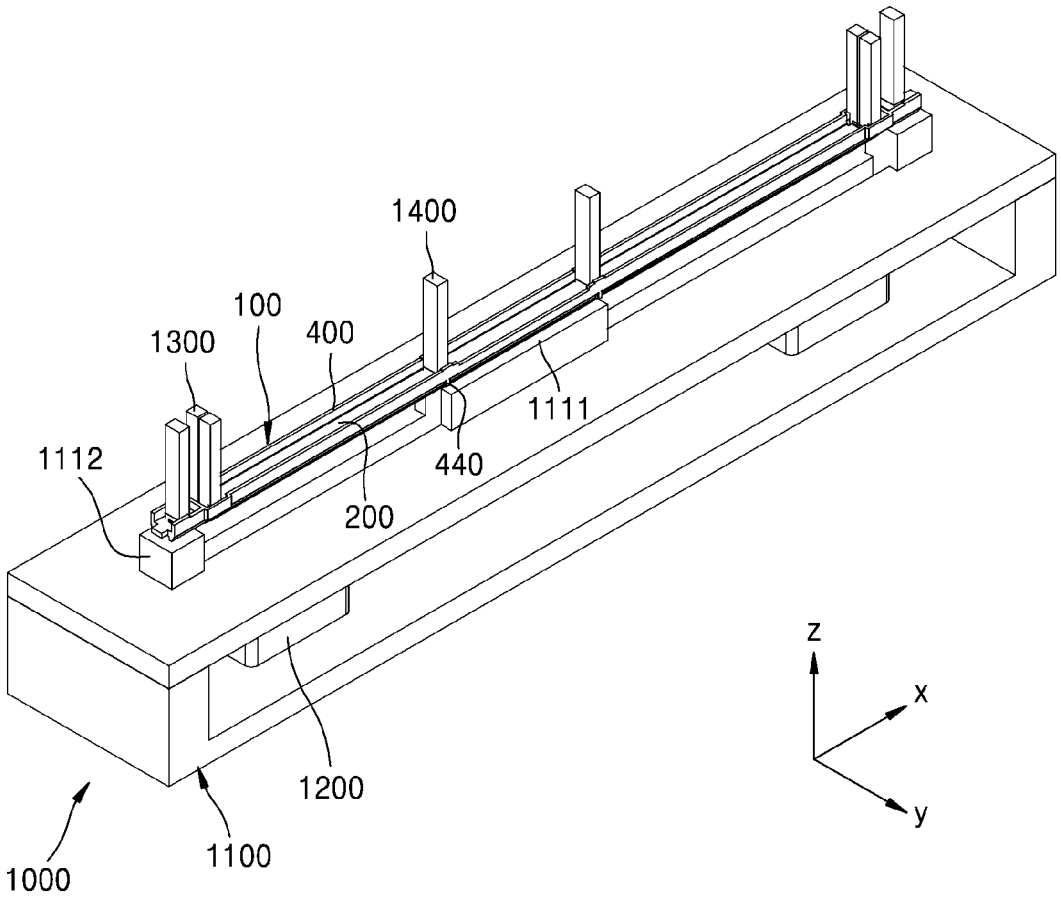
Figure 6A:
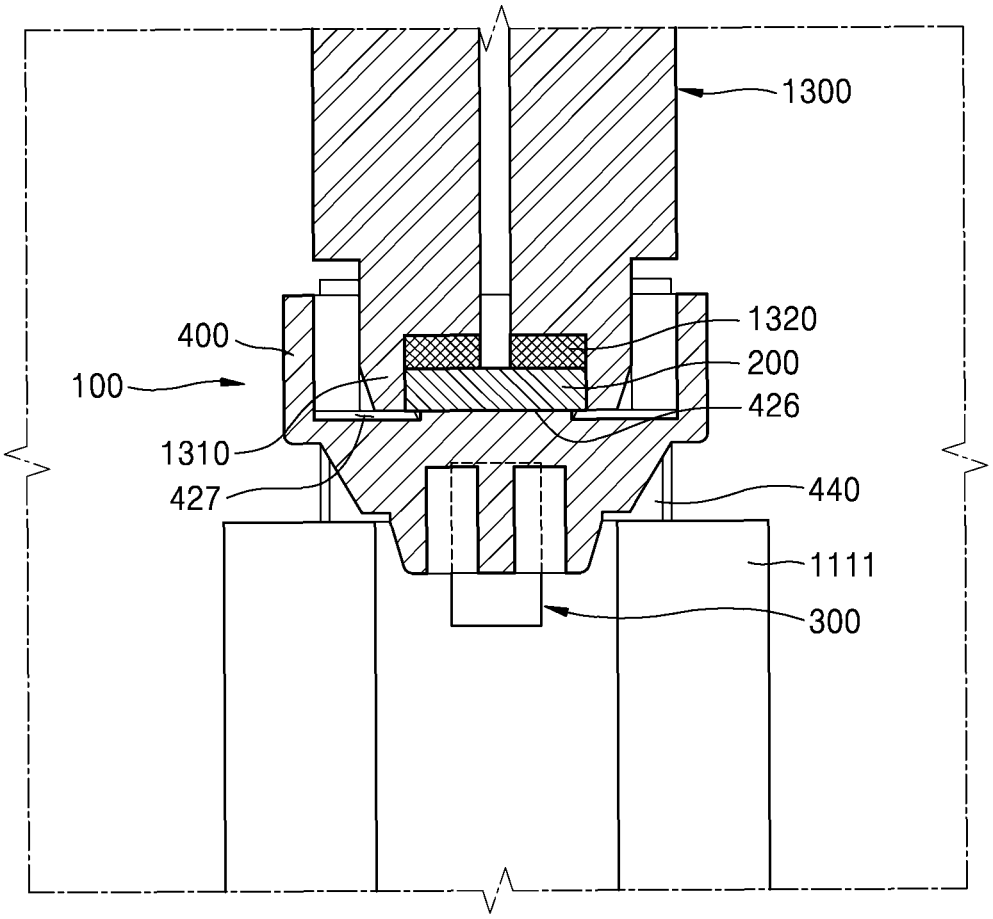
Figure 6B:
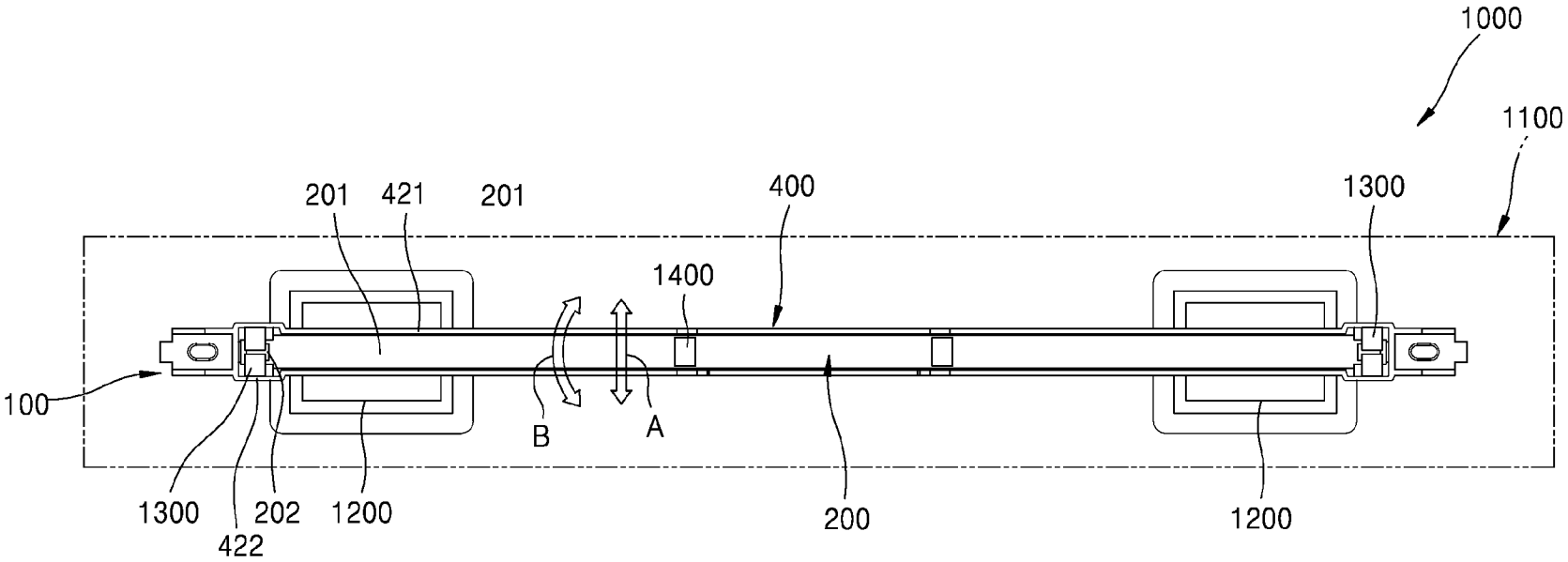
Figure 6C:
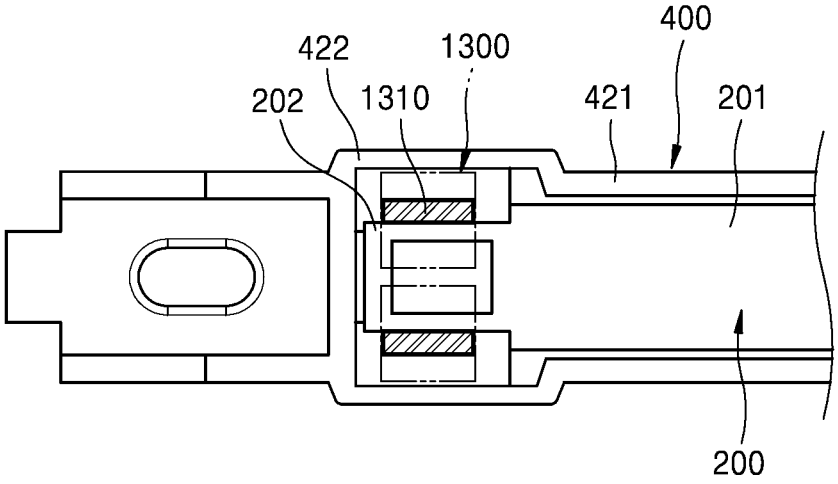

FIGS. 5A-5B and 6A-6C illustrate an exemplary process of adjusting a position of the substrate 200 in the housing 400 during a manufacture of the exposure device 100. FIGS. 5A and 5B are an exploded view and a perspective view, respectively, of an exemplary arrangement for adjusting the position of the substrate 200. FIG. 6A is an exemplary sectional view of the arrangement in the sub-scanning direction (y-axis direction), FIG. 6B is an exemplary plane view of the arrangement, and FIG. 6C is an exemplary partially enlarged view of FIG. 6B.

Referring to FIGS. 5A and 5B, an adjusting device 1000 includes a base frame 1100, an imaging sensor 1200 installed in the base frame 1100, the adjustment gripper 1300 configured to adjust the position of the substrate 200 of the exposure device 100, and a fixing gripper 1400 configured to fix at least a portion of the substrate 200.

The base frame 1100 includes supporting portions 1111 and 1112 configured to support at least a portion of the housing 400 of the exposure device 100. A through hole 1120 may be formed between two supporting portions 1112 to allow a passage of light emitted by the exposure device 100.

When the exposure device 100 is disposed on the adjusting device 1000, supporting portions 1111 and 1112 may support both ends and some part of the housing 400. Since the supporting portions 1111 and 1112 may be installed outside the through hole 1120, they do not interfere with the light emitted by the exposure device 100.

The imaging sensor 1200 may be disposed beneath the through hole 1120. The imaging sensor 1200 may receive light emitted through the lens array 300 of the exposure device 100.

The adjustment gripper 1300 may adjust the position of the substrate 200 of the exposure device 100 being loaded on the adjusting device 1000. The adjustment gripper 1300 may move or tilt the substrate 200 in the width direction of the exposure device 100 based on an image or information received by the imaging sensor 1200.

The adjustment gripper 1300 may be disposed to contact some portion of the substrate 200. For example, referring to FIGS. 6A and 6C, the adjustment gripper 1300 may be disposed such that a finger 1310 of the adjustment gripper 1300 is contact with the second separation region 202 of the substrate 200. An end in the optical axis direction (z-axis direction), of the finger 1310 in the adjustment gripper 1300 may be located in the insertion space 427. In a state that the finger 1310 of the adjustment gripper 1300 contacts both ends, in the width direction, of the second separation region 202, the substrate 200 may be moved or tilted by moving the adjustment gripper 1300 in the width direction of the substrate 200.

The adjustment gripper 1300 may include an elastic member 1320 disposed in a position facing the substrate 200 each other. If the finger 1310 of the adjustment gripper 1300 moves downward to contact the substrate 200, the elastic member 1320 prevents an impact on the substrate 200 by the adjustment gripper 1300 since the adjustment gripper 1300 contacts a upper surface of the substrate 200 through the elastic member 1320. The elastic member 1320 may be a sponge.

The adjustment gripper 1300 may be provided in plural form. For example, there may be two adjustment grippers 1300. The two adjustment grippers 1300 may be disposed at both ends of the substrate 200 in the longitudinal direction. The position of the substrate 200 may be moved as illustrated by arrow "A" by moving the two adjustment grippers 1300 by a same distance in a same direction. Alternatively, the substrate 200 may be tilted as illustrated by an arrow "B" by moving the two adjustment grippers 1300 in different directions or by different distances. For example, the ends of the substrate 200 may be rotated around a central portion of the substrate 200.

While the position and disposed angle of the substrate 200 may be adjusted by the adjustment gripper 1300 as discussed above, the position on which the light generated by the light source 210 is focused on the imaging sensor 1200 through the plurality of lenses 310 may be adjusted. Accordingly, it is possible to manufacture the exposure device 100 having precise position and angle of the substrate 200 with respect to the plurality of lenses 310.

Figure 7A:
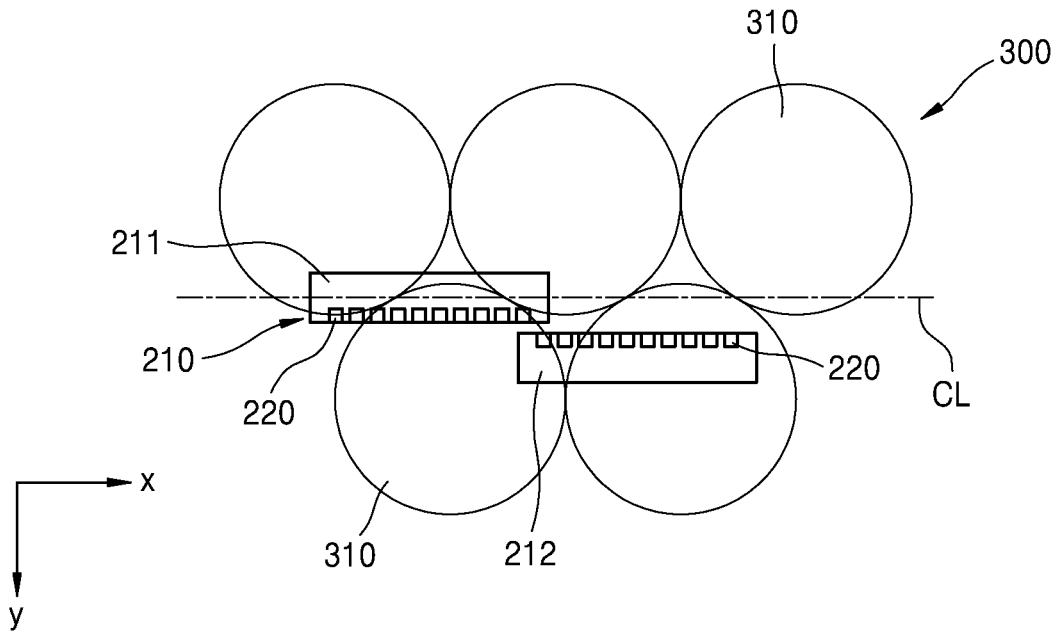
FIGS. 7A and 7B illustrate an exemplary state before a position of a substrate is adjusted by an adjustment gripper.
Figure 7B:
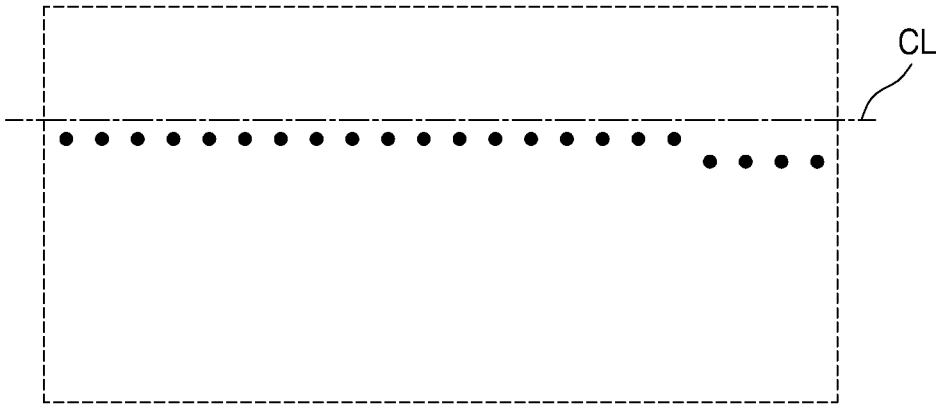
Figure 8A:
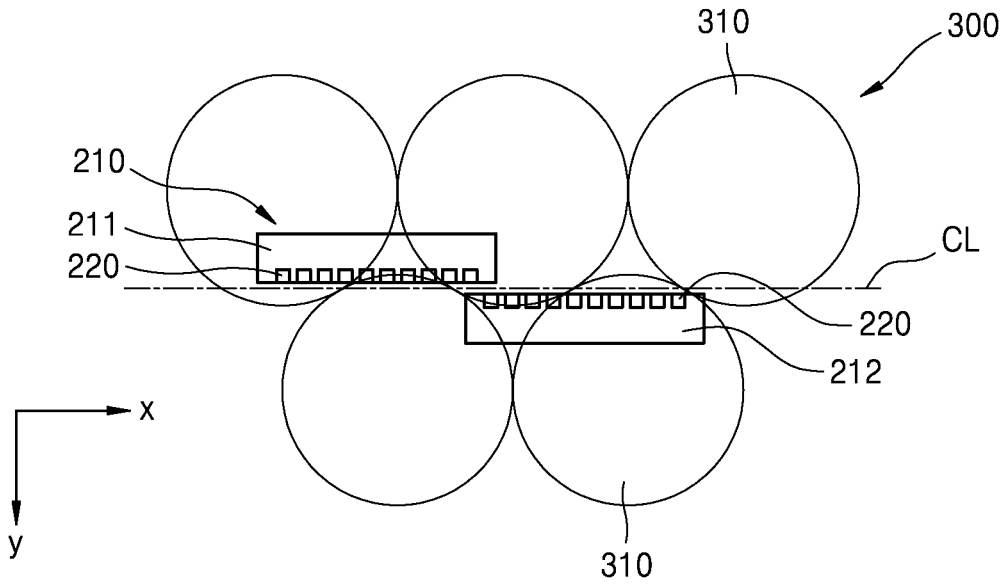
FIGS. 8A and 8B illustrate an exemplary state after a position of a substrate is adjusted by an adjustment gripper.
Figure 8B:
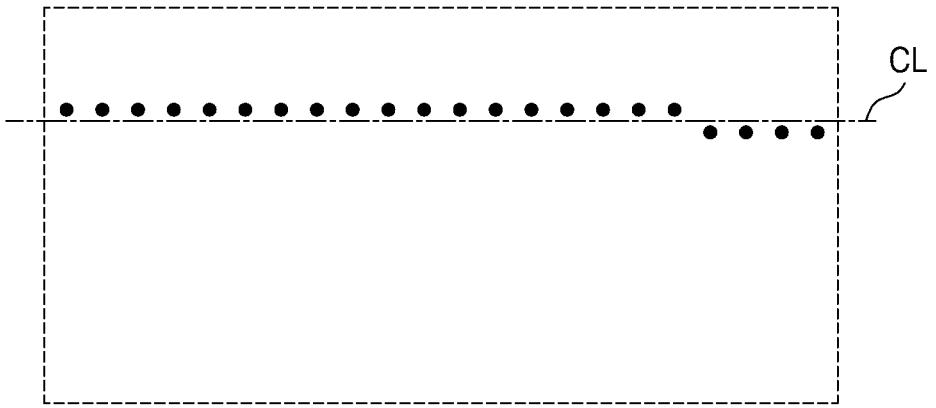

FIGS. 7A and 7B illustrate an exemplary state before the position of the substrate 200 is adjusted by the adjustment gripper 1300, and FIGS. 8A and 8B illustrate exemplary state after the position of the substrate 200 is adjusted by the adjustment gripper 1300. FIGS. 7A and 8A schematically illustrate the positions of the plurality of lenses 310 and the light source 210, and FIGS. 7B and 8B illustrate plotted results of experiments that measured, by the imaging sensor 1200, positions of light incident points emitted by the exposure device 100.

Referring to FIGS. 7A and 7B, the plurality of light sources 210 displaced in the sub-scanning direction (y-axis direction deviate from a center line "CL" of the lens array 300. An offset, from the center line "CL" of the lens array 300, of an odd-numbered optical source 211 may be different from an offset of an even-numbered optical source 212. If the exposure device 100 operates in this state, a printing quality of an image forming apparatus employing such an exposure device 100 may not be good since a shape of focus and an amount of light emitting through the plurality of lenses 310 may be different from one another among the plurality of lenses 310.

According to an embodiment, the position of the substrate 200 may be adjusted by the adjustment gripper 1300. Referring to FIGS. 8A and 8B, the position of the substrate 200 may be adjusted such that the offset, from the center line "CL" of the lens array 300, of the odd-numbered optical source 211 is the same as the offset of the even-numbered optical source 212. If the exposure device 100 operates in such a state, an image forming apparatus employing such an exposure device 100 will have a good printing quality since a shape of focus and an amount of light emitted through the plurality of lenses 310 are uniform among the plurality of lenses 310.

The substrate 200 may be fixed in the housing 400 after the position and the direction of the substrate 200 are adjusted. As an example, the substrate 200 may be fixed by bonding to the housing 400. However, the method of fixing the substrate 200 to the housing 400 is not limited to bonding, and various fixing methods that do not induce a displacement of the substrate 200 may be used.

Referring to FIG. 5B, the fixing gripper 1400 may be arranged to contact the upper surface of the substrate 200. The fixing gripper 1400 may prevent the substrate 200 from bending upwards when the position and the direction of the substrate 200 are adjusted by the adjustment gripper 1300.

Referring to FIG. 6A, the second separation region 202 of the substrate 200 may be supported by the second supporting face 426 in the optical axis direction (z-axis direction). Thus, even if the substrate 200 is pressed by the adjustment gripper 1300 in a direction parallel with the optical axis direction (z-axis direction), the substrate 200 is prevented from bending in the optical axis direction (z-axis direction).

Referring to FIG. 5B, the housing 400 may further include at least one rib 440. For example, the housing 400 may include two ribs 440. The rib 440 may be provided in a central portion of the housing 400 in the longitudinal direction. The rib 440 may be supported by the supporting portion 1111 of the base frame 1100. The central portion of the housing 400 in the longitudinal direction may maintain the same height as the both ends of the housing 400 due to the rib 440. That is, the rib 440 may prevent the housing 400 from bending when the housing 400 is seated on the supporting portion 1111.

Figure 9:
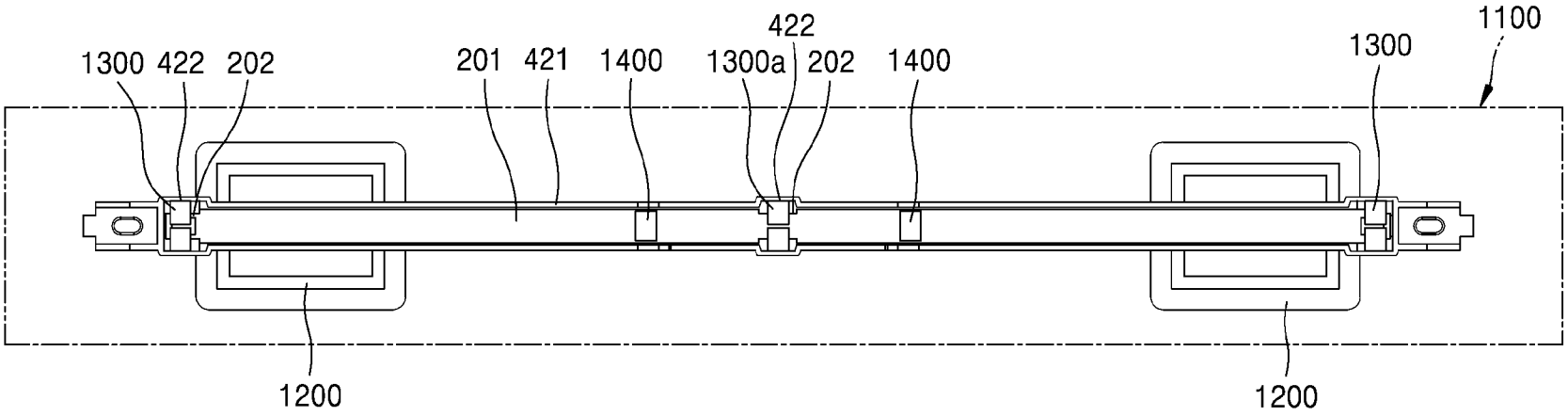
FIG. 9 is a schematic diagram illustrating an exposure device according to another embodiment.

The above descriptions included examples that use two adjustment grippers 1300, which are disposed at two ends of the substrate 200. However, the number and the position of the adjustment gripper 1300 are not limited thereto and may be modified in various manners. For example, as shown in FIG. 9, an adjustment gripper 1300*a* may further be disposed in a central position of the substrate 200 in the longitudinal direction. As a result, both ends and the central position of the substrate 200 may be moved simultaneously by the three adjustment grippers 1300, 1300*a*, and 1300. To implement this feature, the first separation region 422 of the substrate 200 may further be disposed in its central position in addition to both ends of the housing 400. As another example, the first separation region 422 of the substrate 200 may be disposed in its central position instead of both ends of the housing 400 (not shown).

Figure 10A:
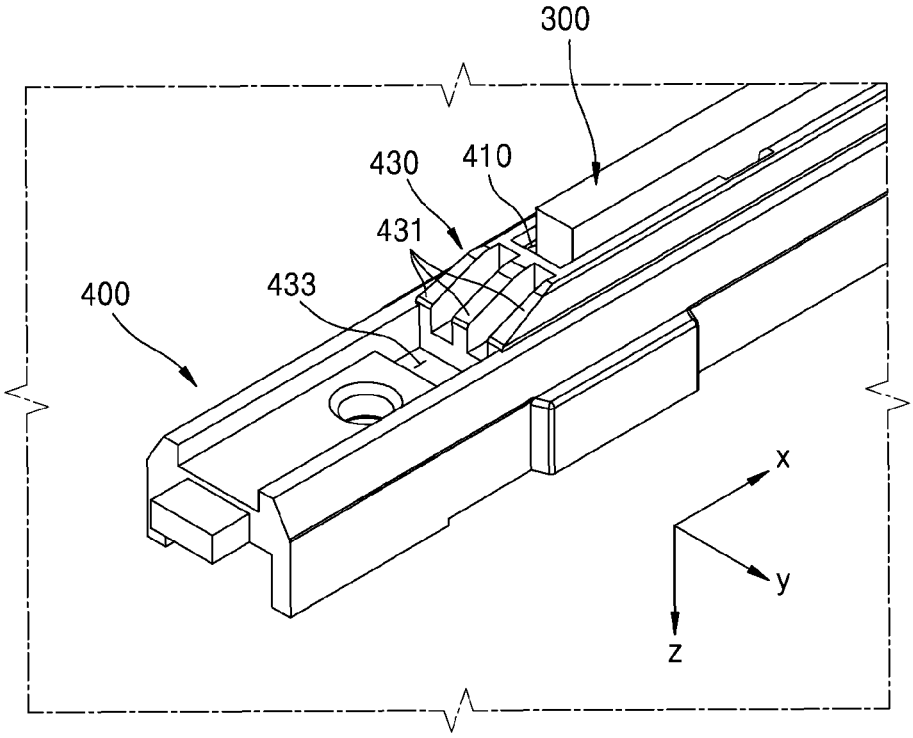
FIG. 10A is an expanded perspective view of a portion of the exemplary exposure device of FIG. 1.
Figure 10B:
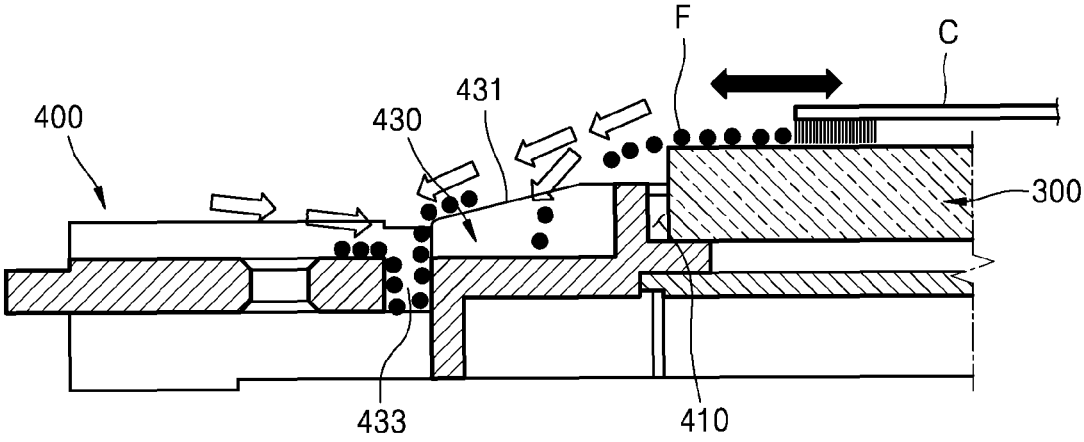
FIG. 10B is a longitudinally sectional view of the exemplary exposure device of FIG. 10A.
Figure 11:
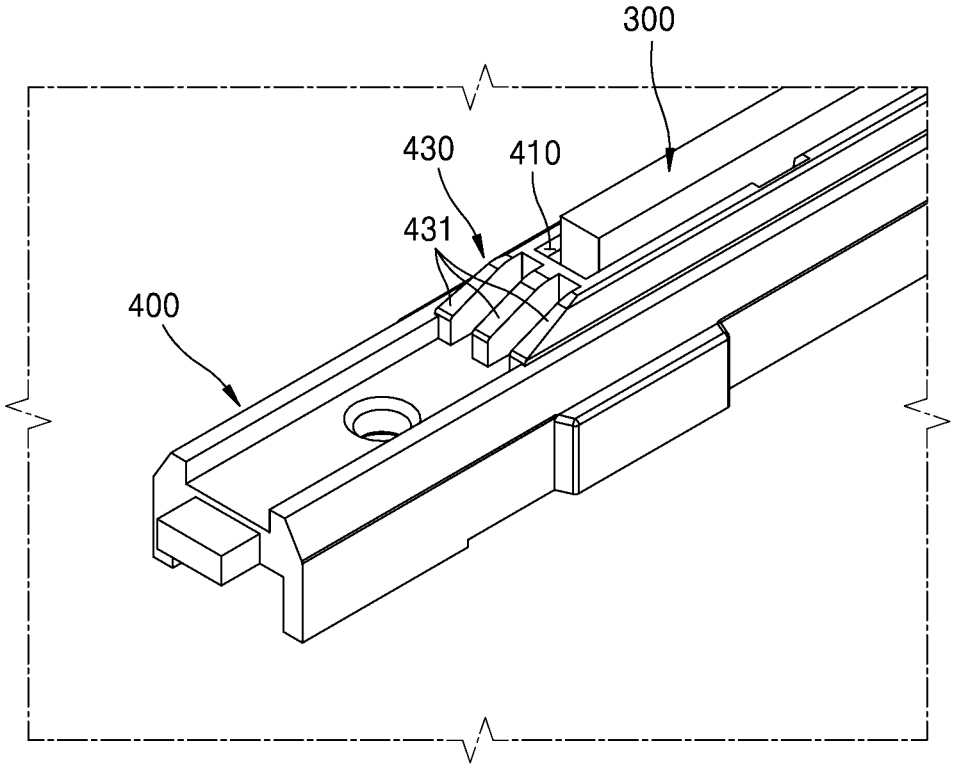
FIG. 11 is a schematic diagram illustrating an exposure device according to another embodiment.

FIG. 10A is an expanded perspective view of a portion of the exposure device 100 of FIG. 1, and FIG. 10B is a longitudinally sectional view of the exposure device 100 of FIG. 10A.

Referring to FIGS. 10A and 10B, the housing 400 may include the lens supporting portion 410 configured to accommodate at least some of the lens array 300, and a slope portion 430 of which height is lowered in an outward direction from an end of the lens supporting portion 410. The height of the slope portion 430 may be lowered toward the longitudinal end of the housing 400. The slope portion 430 may include a plurality of slope walls 431 displaced apart in the width direction. A certain space is provided between the slope walls 431.

When foreign substances adhered to the lens array 300 are being removed by a cleaning member "C", the slope portion 430 may suppress the removed foreign substances to return to the lens array 300. Some portion of the foreign substances separated from the lens array 300 are moved on a slanting surface of the slope wall 431 in a direction away from the lens array 300, and the other portion is moved to the space between the slope walls 431. Thus, the removed foreign substances are prevented from returning to the lens array 300.

Further, a through hole 433 may be provided at an end of the slope portion 430. The removed foreign substances may be discharged downwards through the through hole 433. The through hole 433 may prevent the removed foreign substances "F" from building up in the housing 400. However, the forming of the through hole 433 is optional, and the through hole 433 may not be formed in the housing 400.

Figure 12:
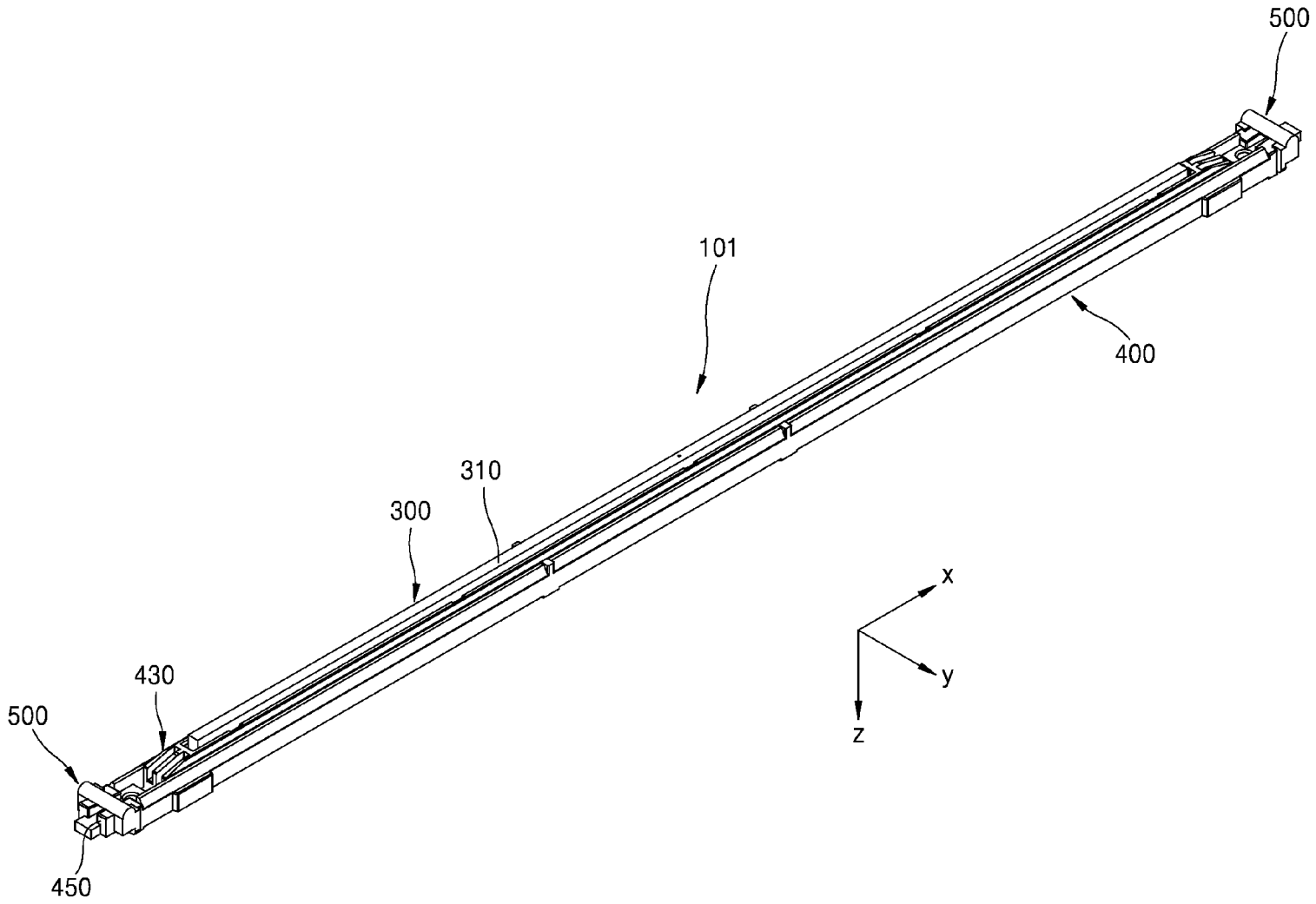
FIG. 12 is a perspective view of an exposure device according to another embodiment.
Figure 13:
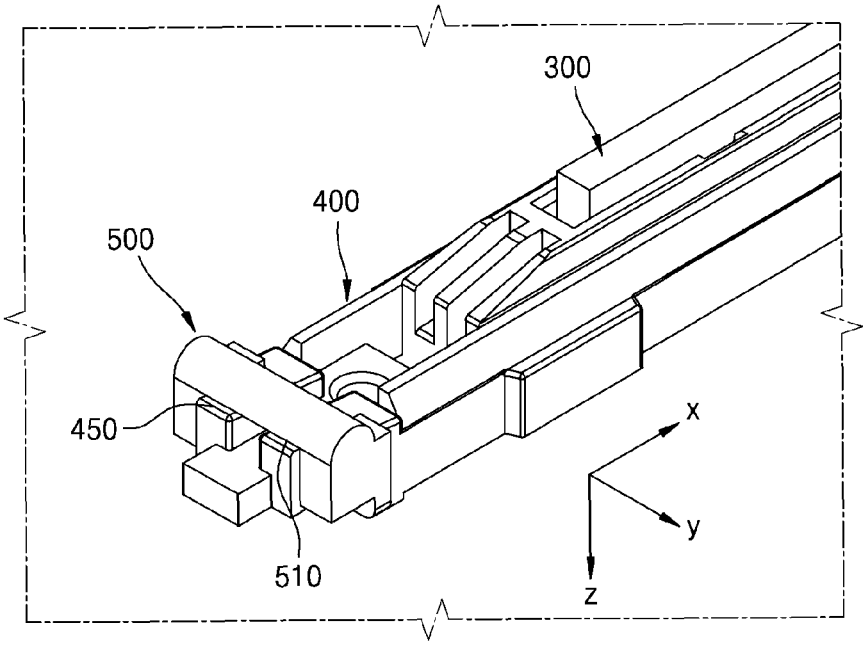
FIG. 13 is an exemplary partially enlarged view of FIG. 12.

FIG. 12 is a perspective view that schematically illustrates an exposure device 101 according to another embodiment. FIG. 13 is a partially enlarged view of FIG. 12.

Referring to FIG. 12, the exposure device 101 may include the substrate 200 on which the plurality of light sources 210 are disposed, the lens array 300 including the plurality of lenses 310, and the housing 400 configured to support the substrate 200 and the lens array 300. The substrate 200, the lens array 300, and the housing 400 are similar to those in the embodiments discussed above, and detailed description thereof will be omitted.

The exposure device 101 may include at least one position setting member 500 fixedly installed in the housing 400. For example, the position setting member 500 may be fixedly installed at both ends of the housing 400. The position setting member 500 may be fixed to the housing 400 by adhesive.

The housing 400 includes a slope guide portion 450 elongated in a direction slanting from the main-scanning direction. The position setting member 500 include a contact portion 510 that contacts the slope guide portion 450 of the housing 400. The direction that the slope guide portion 450 is elongated may be perpendicular to the main-scanning direction (x-axis direction), and the sub-scanning direction (y-axis direction). An adhesion bond (not shown) may be arranged between the slope guide portion 450 and the contact portion 510, so that the position setting member 500 is fixed to the housing 400.

However, the position that the position setting member 500 is fixed to the housing 400 is not limited to between the slope guide portion 450 and the contact portion 510, but may be modified in various manners only if the position is between the housing 400 and the position setting member 500. A method of fixing the position setting member 500 to the housing 400 is not limited to boding, and various fixing methods that do not induce a displacement of the position setting member 500 may be used.

As the position of the position setting member 500 may be fixed with respect to the housing 400, positions of an end of the position setting member 500 in the optical axis direction (z-axis direction) and the end of the lens array 300 in the optical axis direction (z-axis direction) may be fixed.

Figure 14:
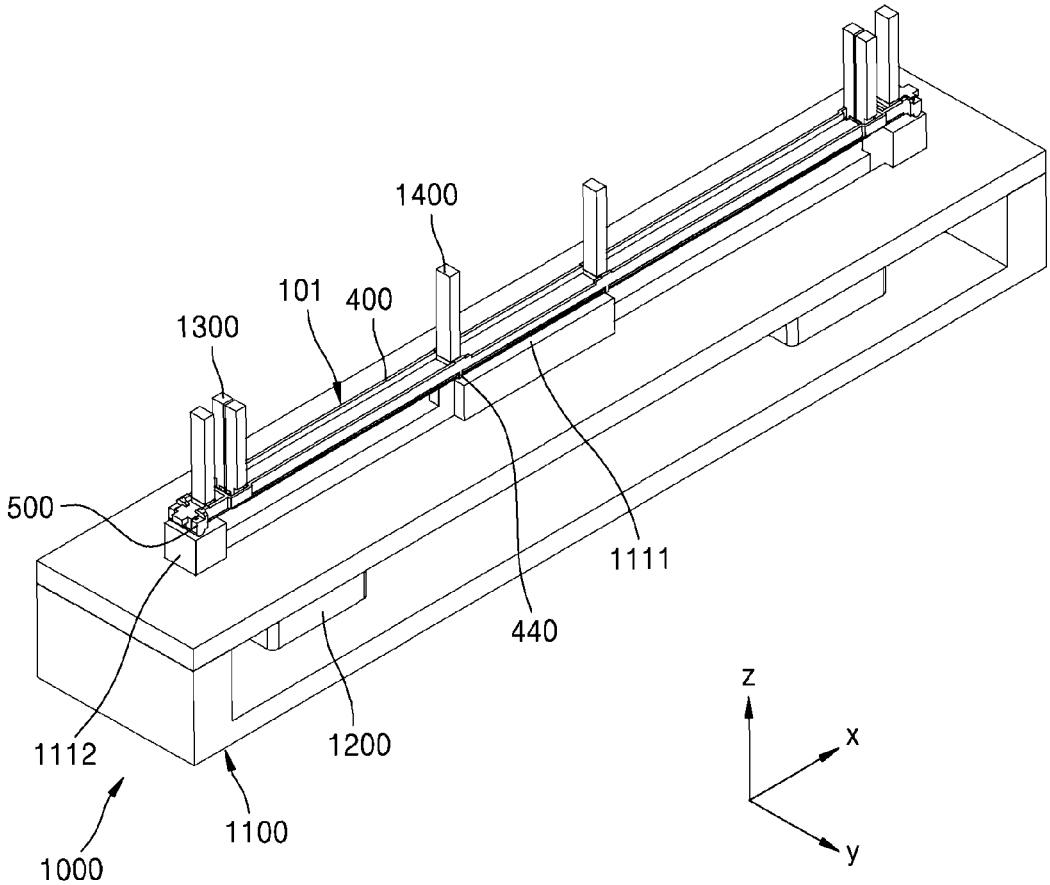
FIGS. 14, 15, 16A, and 16B illustrate an exemplary process of adjusting a position of a position setting member in a housing during a manufacture of an exposure device.
Figure 15:
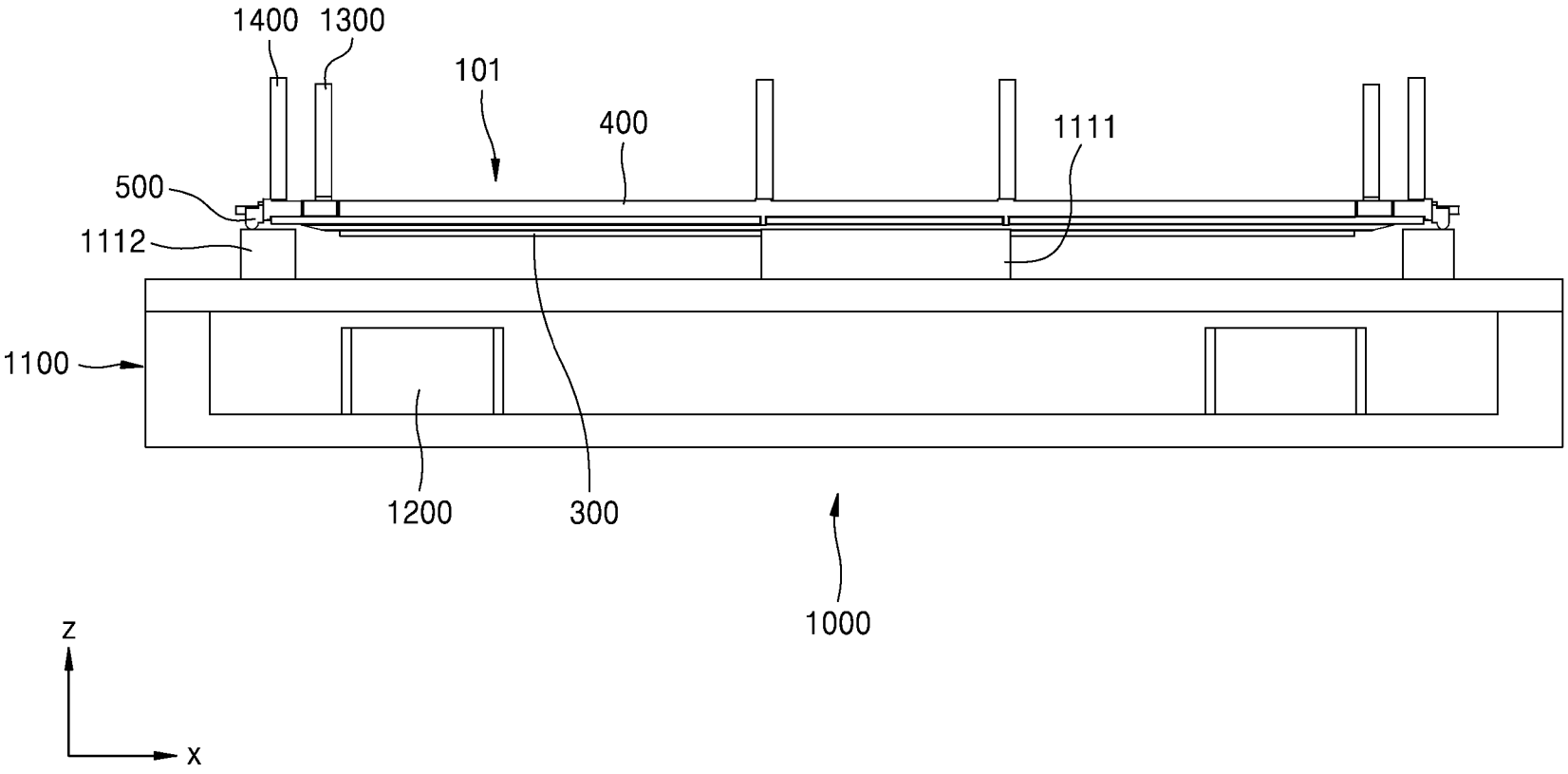
Figure 16A:
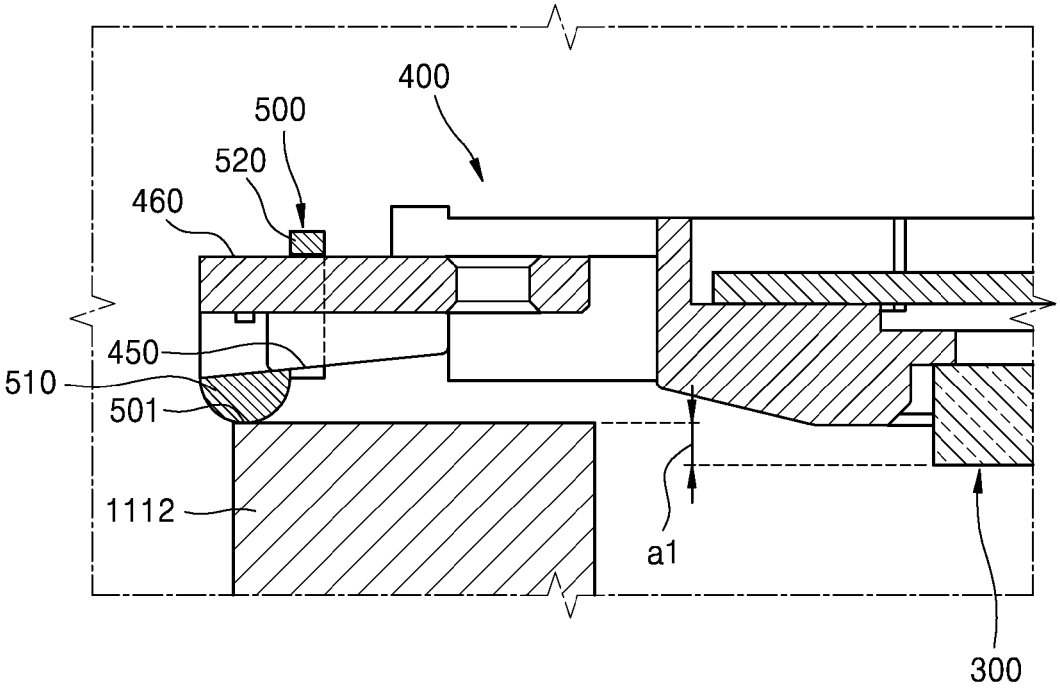
Figure 16B:
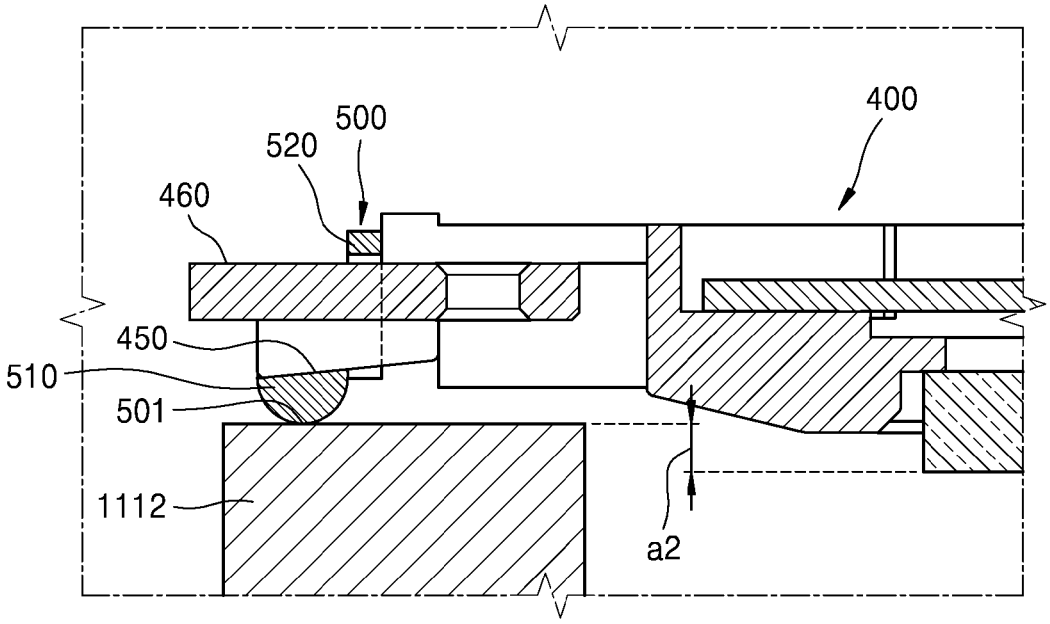

FIGS. 14, 15, 16A, and 16B illustrate an exemplary process of adjusting the position of the position setting member 500 in the housing 400 during a manufacture of the exposure device 101. FIG. 14 is a perspective view of an exemplary arrangement for adjusting the position, and FIG. 15 is a front view of the arrangement. FIGS. 16A and 16B are sectional views of the exposure device 101 in the longitudinal direction, where FIG. 16A illustrates a state before the position of the position setting member 500 is adjusted and FIG. 16B illustrates a state after the position of the position setting member 500 is adjusted.

During a manufacture of the exposure device 101, the slope guide portion 450 of the housing 400 contacts the contact portion 510 of the position setting member 500, but the position setting member 500 is not fixed to the housing 400. The position setting member 500 further includes a stopper 520 faced to a surface 460 opposite to the slope guide portion 450 of the housing 400. The stopper 520 may contact the opposite surface 460 of the housing 400 when the position setting member 500 moves in the main-scanning direction (x-axis direction). Accordingly, the stopper 520 may prevent the position setting member 500 from falling from the housing 400 or limit a movable range of the position setting member 500.

In such a state, the exposure device 101 may be disposed on the adjusting device 1000. For example, the exposure device 101 may be disposed on the adjusting device 1000 such that the position setting member 500 is supported by the supporting portions 1111 and 1112. A plurality of grippers 1300 and 1400 that presses the exposure device 101 downwards are disposed on the exposure device 101.

Since the position setting member 500 is not yet fixed to the housing 400, the contact portion 510 of the position setting member 500 may be moved along the slope guide portion 450.

Before the position setting member 500 is moved with respect to the housing 400, the end 501 of the position setting member 500 in the optical axis direction (z-axis direction) contacts and is supported by the supporting portion 1112 of the base frame 1100, and a distance between the end 501 of the position setting member 500 in the optical axis direction (z-axis direction) and the end of the lens array 300 in the optical axis direction (z-axis direction) may be "a1".

As the position setting member 500 is moving as shown in FIG. 16B, the position of the position setting member 500 moves in the main-scanning direction. However, since the motion of the position setting member 500 in the optical axis direction is limited by the supporting portion 1112, the housing 400 having the slope guide portion 450 moves in the optical axis direction (z-axis direction). Accordingly, the lens array 300 supported by the housing 400 moves in the optical axis direction (z-axis direction). That is, when the position setting member 500 is moved along the slope guide portion 450, the position of the position setting member 500 in the optical axis direction (z-axis direction) is fixed and the position of the lens array 300 in the optical axis direction (z-axis direction) changes. As a result, the distance between the end 501 of the position setting member 500 in the optical axis direction (z-axis direction) and the end of the lens array 300 in the optical axis direction may be adjusted from "a1" to "a2".

Since a distance between the position setting member 500 and the imaging sensor 1200 in the optical axis direction (z-axis direction) is constant, a spacing between the lens array 300 and the imaging sensor 1200 in the optical axis direction (z-axis direction) may change as the position of the lens array 300 in the optical axis direction (z-axis direction) changes. The spacing between the exposure device 101 and the imaging sensor 1200 in the optical axis direction (z-axis direction) may be adjusted by adjusting the position setting member 500. As the spacing is adjusted, the image or information detected by the imaging sensor 1200 may also be changed.

Thus, positions, in the optical axis direction (z-axis direction), of the lens array 300, the substrate 200, and the housing 400 configured to supporting them may be adjusted easily by adjusting the position of the position setting member 500 while checking image forming positions through the imaging sensor 1200 in real time. For example, the position of the position setting member 500 may be adjusted while a change of average modulation transfer function (MTF) according to changes in position of the exposure device 101 in the optical axis direction (z-axis direction) is being checked through the imaging sensor 1200.

In a state that the position of the position setting member 500 is adjusted as such, the position setting member 500 is fixed to the housing 400. The position setting member 500 may be fixed to the housing 400 by arranging the adhesion bond between the slope guide portion 450 and the contact portion 510. However, the method of fixing the position setting member 500 to the housing 400 is not limited to gluing, and various fixing methods that do not induce a displacement of the position setting member 500 may be used as well. Thus, the exposure device 101 having the MTF suitable for implementing high quality images may be manufactured.

The exposure device 101 may be fixed inside an image forming apparatus by the position setting member 500. Thus, the lens array 300 of the exposure device 101 is disposed to be spaced apart from the photosensitive drum 20 by a certain spacing.

Figure 17:
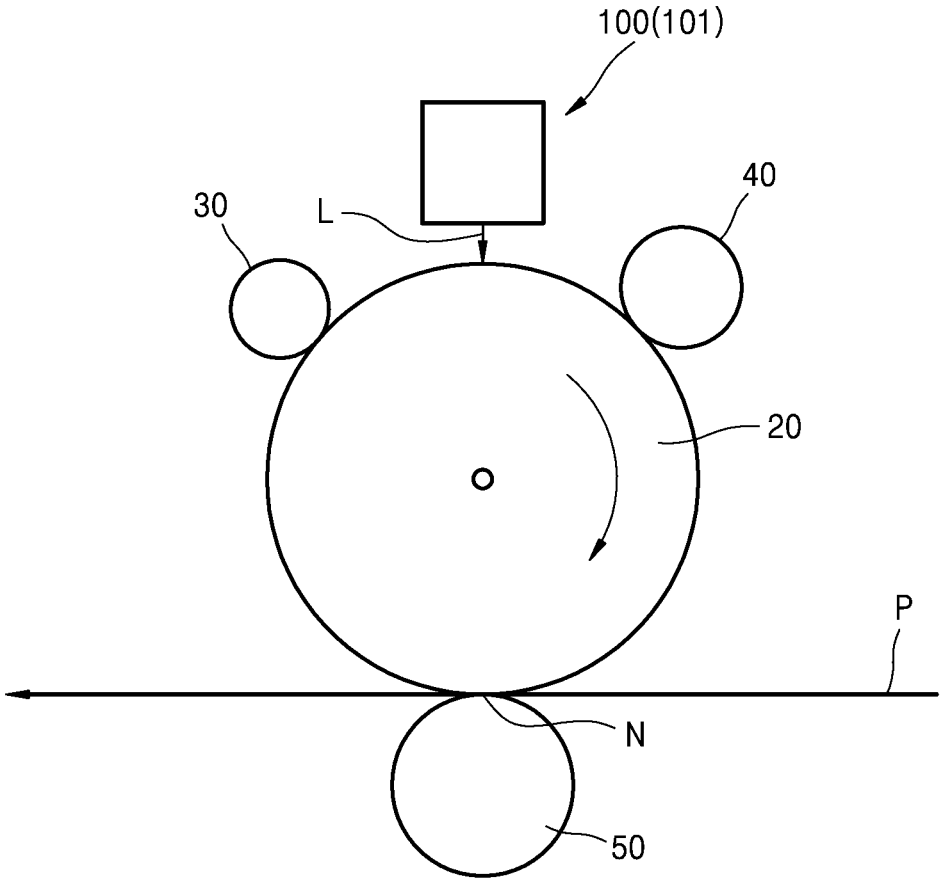
FIG. 17 is a schematic diagram of an image forming apparatus according to an embodiment.

FIG. 17 is a schematic diagram of an image forming apparatus 10 according to an embodiment. Referring to FIG. 17, the image forming apparatus 10 is an electrophtographic image forming apparatus that prints images on the printing medium electrophtographically. The image forming apparatus 10 includes the exposure device 100 or 101 according to embodiments described above.

The image forming apparatus 10 includes a photosensitive drum 20, a charging roller 30, a developing roller 40, and a transfer roller 50.

The photosensitive drum 20 is a kind of photosensitive medium on which an electrostatic latent image is formed, and has a cylindrical metal pipe and a photosensitive layer having a photoconductive property and formed on an outer periphery of the cylindrical metal pipe. The charging roller 30 is a type of a charger configured to charge a surface of the photosensitive drum 20 to a uniform electric potential. To the charging roller 30, applied is a charging bias. A corona charger (not shown) may be used as well instead of the charging roller 30.

The exposure device 100 or 101 forms an electrostatic latent image on a surface of the photosensitive drum 20 by scanning light "L" modulated with image information on the photosensitive drum 20 charged with a uniform electric potential.

The developing roller 40 feeds toner to the electrostatic latent image formed on the photosensitive drum 20 to develop the electrostatic latent image into a visible toner image. The transfer roller 50 is a type of a transferor and is arranged to face the surface of the photosensitive drum 20 to form a transfer nip "N". A transfer bias voltage for transferring the toner image developed on the surface of the photosensitive drum 20 to a recording medium "P" is applied to the transfer roller 50. A corona transferor may be used instead of the transfer roller 50.

In the exposure device according to an embodiment and the image forming apparatus employing the exposure device, the substrate on which a plurality of light sources are arranged is spaced apart from the housing in the main-scanning direction, and the positions and directions of the plurality of light sources with respect to a plurality of lenses in the main-scanning direction and the sub-scanning direction may be adjusted easily in the manufacture of the exposure device. Thus, the light generated by the light sources may be focused precisely on the scanned surface through the lenses.

The exposure device according to another embodiment and the image forming apparatus employing the exposure device include a position setting member of which ends may be moved easily with respect to the housing in the optical axis direction. The position setting member facilitates adjustment of the distance between the photosensitive medium and the exposure device. Thus, the light generated by the light sources may be focused precisely on the scanned surface through the lenses.

Although a monochromatic electrophtographic image forming is described above, the present disclosure is not limited thereto and may employ a color electrophtographic image forming. A direct transfer type was exemplified above, however, an indirect transfer type using an intermediate transfer belt may also be employed.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope as defined by the following claims.

What is claimed is:

1. An exposure device comprising:

a substrate on which a plurality of light sources are arranged along a main-scanning direction of the exposure device;

a lens array including a plurality of lenses configured to focus light emitted by the plurality of light sources that are arranged on the substrate on a scanned surface; and a housing configured to support the substrate and the lens array such that a certain spacing is maintained between the plurality of light sources and the plurality of lenses, wherein at least a portion of the substrate is spaced apart from the housing along a sub-scanning direction of the exposure device, and wherein the housing comprises:

a first supporting region configured to support the substrate in the sub-scanning direction of the exposure device; and a first separation region spaced apart from the substrate in the sub-scanning direction of the exposure device.

2. The exposure device of claim 1, wherein a width of the first separation region is greater than a width of the first supporting region.

3. The exposure device of claim 1, wherein the substrate comprises:

a second supporting region supported by the first supporting region in the sub-scanning direction of the exposure device; and a second separation region spaced apart from the first separation region in the sub-scanning direction of the exposure device.

4. The exposure device of claim 3, wherein a width of the second separation region is less than a width of the second supporting region.

5. The exposure device of claim 3, wherein a separation distance between the first supporting region and the second supporting region is greater than or equal to about 10% of a width of the second supporting region.

6. The exposure device of claim 3, wherein a separation distance between the first separation region and the second separation region is less than or equal to about 100% of a width of the second supporting region.

7. The exposure device of claim 1, wherein the housing comprises:

a supporting face configured to support the substrate in a direction perpendicular to the sub-scanning direction of the exposure device and in a direction perpendicular to the main-scanning direction of the exposure device; and an insertion space recessed inwardly from the supporting face and spaced apart from the substrate.

8. The exposure device of claim 7, wherein the supporting face comprises:

a first supporting face configured to support a central portion of the substrate; and a second supporting face configured to support both ends of the substrate.

9. The exposure device of claim 1, wherein the housing comprises:

a lens supporting portion configured to accommodate at least a portion of the lens array; and a slope portion of which a height is lowered in an outward direction from an end of the lens supporting portion.

10. The exposure device of claim 9, wherein the slope portion comprises:

a plurality of slanting walls displaced apart in the sub-scanning direction of the exposure device.

11. The exposure device of claim 9, wherein a through hole is disposed in an end of the slope portion.

12. The exposure device of claim 1, wherein the housing comprises:

a slope guide portion elongated in a direction slanting from the main-scanning direction, wherein the exposure device further comprises:

at least one position setting member fixed to the housing, at least a portion of the at least one position setting member contacts the slope guide portion of the housing.

13. The exposure device of claim 1, wherein at least a part of the substrate is fixed to the housing by bonding.

14. An exposure device comprising:

a substrate on which a plurality of light sources are arranged along a main-scanning direction of the exposure device;

a lens array including a plurality of lenses configured to focus light emitted by the plurality of light sources that are arranged on the substrate on a scanned surface; and a housing configured to support the substrate and the lens array such that a certain spacing is maintained between the plurality of light sources and the plurality of lenses, wherein at least a portion of the substrate is spaced apart from the housing along a sub-scanning direction of the exposure device, and wherein a distance between the substrate and the housing in the sub-scanning direction of the exposure device ranges from 10% to 100% of a width of the substrate.

15. An exposure device comprising:

a substrate on which a plurality of light sources are arranged along a main-scanning direction of the exposure device;

a lens array including a plurality of lenses configured to focus light emitted by the plurality of light sources that are arranged on the substrate on a scanned surface;

a housing configured to support the substrate and the plurality of lenses such that a certain spacing is maintained between the plurality of light sources and the plurality of lenses; and at least one position setting member fixed to the housing, wherein the housing comprises:

a slope guide portion elongated in a direction slanting from the main-scanning direction of the exposure device and configured to contact the at least one position setting member.

16. The exposure device of claim 15, wherein at least a part of the at least one position setting member is fixed to the housing by gluing.

17. The exposure device of claim 15, wherein the at least one position setting member comprises:

a contact portion configured to contact the slope guide portion of the housing; and a stopper faced to a surface opposite to the slope guide portion of the housing.

18. An image forming apparatus comprising:

an exposure device including:

a substrate on which a plurality of light sources are arranged along a main-scanning direction of the exposure device, a lens array including a plurality of lenses configured to focus light emitted by the plurality of light sources that are arranged on the substrate on a scanned surface, and a housing configured to support the substrate and the lens array such that a certain spacing is maintained between the plurality of light sources and the plurality of lenses, wherein at least a portion of the substrate is spaced apart from the housing along a sub-scanning direction, and, wherein the housing comprises:

a first supporting region configured to support the substrate in the sub-scanning direction of the exposure device; and a first separation region spaced apart from the substrate in the sub-scanning direction of the exposure device.

* * * * *